US005175070A

United States Patent [19]

Tanikawa et al.

[11] Patent Number: 5,175,070

[45] Date of Patent: Dec. 29, 1992

[54] IMAGE FORMING METHOD AND IMAGE FORMING APPARATUS

[75] Inventors: Hirohide Tanikawa; Yasutaka Akashi, both of Yokohama; Masaaki Taya, Kawasaki; Kuniko Kobayashi, Koganei; Masaki Uchiyama, Ichikawa, all of Japan

[73] Assignee: Canon Kabushiki Kaisha, Tokyo, Japan

[21] Appl. No.: 588,436

[22] Filed: Sep. 26, 1990

[30] Foreign Application Priority Data

| | | | |
|---|---|---|---|
| Sep. 27, 1989 | [JP] | Japan | 1-249061 |
| Oct. 12, 1989 | [JP] | Japan | 1-263848 |
| Dec. 7, 1989 | [JP] | Japan | 1-316528 |

[51] Int. Cl.[5] ..... G03G 13/08

[52] U.S. Cl. ..... 430/122; 355/265

[58] Field of Search ..... 430/122, 106.6; 355/265

[56] References Cited

U.S. PATENT DOCUMENTS

| | | | |
|---|---|---|---|
| 2,297,691 | 4/1939 | Carlson | 95/5 |
| 3,405,682 | 10/1968 | King et al. | 118/637 |
| 3,666,363 | 2/1971 | Tanaka et al. | 355/17 |
| 3,776,722 | 12/1973 | Cantarano | 355/265 |
| 3,866,574 | 2/1975 | Hardennrook et al. | 118/637 |
| 3,890,929 | 6/1975 | Walkup | 118/637 |
| 3,893,418 | 7/1975 | Liebman et al. | 118/637 |
| 4,071,361 | 1/1978 | Marushima | 96/1.4 |
| 4,380,966 | 4/1983 | Isaka et al. | 118/651 |
| 4,386,577 | 6/1983 | Hosono et al. | 118/675 |
| 4,395,476 | 7/1983 | Kanbe et al. | 430/102 |
| 4,444,864 | 4/1984 | Takahashi | 430/122 |
| 4,565,438 | 1/1986 | Folkins | 335/3 DD |
| 4,600,295 | 7/1986 | Suzuki | 355/265 |
| 4,688,923 | 8/1987 | Kohyama | 355/265 |
| 4,827,869 | 5/1989 | Takagi | 355/265 |
| 4,904,558 | 2/1990 | Nagatsuka et al. | 430/122 |
| 4,957,840 | 9/1990 | Sakashita et al. | 430/106.6 |
| 4,978,597 | 12/1990 | Nakahara | 430/122 |
| 4,985,327 | 1/1991 | Sakashita et al. | 430/106.6 |
| 4,992,348 | 2/1991 | Hayakawa et al. | 430/85 |
| 5,009,973 | 4/1991 | Yoshida et al. | 430/45 |
| 5,014,089 | 5/1991 | Sakashita et al. | 355/251 |

FOREIGN PATENT DOCUMENTS

| | | | |
|---|---|---|---|
| 314459 | 5/1989 | European Pat. Off. | 430/106.6 |
| 331425 | 9/1989 | European Pat. Off. | 430/106.6 |
| 331426 | 9/1989 | European Pat. Off. | 430/106.6 |
| 43037 | 4/1979 | Japan . | |
| 18656 | 2/1980 | Japan . | |
| 18657 | 2/1980 | Japan . | |
| 18658 | 2/1980 | Japan . | |
| 18659 | 2/1980 | Japan . | |
| 66455 | 4/1982 | Japan . | |
| 73647 | 4/1985 | Japan . | |
| 2145942 | 4/1985 | United Kingdom | 355/265 |

*Primary Examiner*—Marion E. McCamish
*Assistant Examiner*—Christopher D. RoDee
*Attorney, Agent, or Firm*—Fitzpatrick, Cella, Harper & Scinto

[57] ABSTRACT

An image forming apparatus is formed by providing a latent image-bearing member for holding an electrostatic image thereon and a toner-carrying member for carrying a prescribed magnetic toner comprising a binder resin and magnetic powder and having a particle size distribution including 12% by number or more of magnetic toner particles of 5 microns or smaller, 33% by number or less of magnetic toner particles of 8-12.7 microns and 2% by volume or less of magnetic toner parcitles of 16 microns or larger so as to provide a volume-average particle size of 4-10 microns. At the developing station, an alternating bias voltage comprising a DC voltage and an unsymmetrical AC voltage in superposition is applied between the toner-carrying member and the latent image-bearing member to provide an alternating bias electric field comprising a development-side voltage component and a reverse-development side voltage component. The development-side voltage component has a magnitude equal to or larger than that of the reverse development-side voltage component and a duration smaller than that of the reverse-development side voltage component, so that the magnetic toner on the toner-carrying member, particularly fine powdery fraction thereof effective for high-quality development, is effectively transferred to the latent image-bearing member to develop the electrostatic image thereon at the developing station.

23 Claims, 11 Drawing Sheets

WAVEFORM OF SUPPLY 6

WAVEFORM OF SUPPLY 7

WAVEFORM OF SUPPLY 8

WAVEFORM OF SUPPLY 9

WAVEFORM OF SUPPLY 10

WAVEFORM OF SUPPLY 11

IMAGE FORMING METHOD AND IMAGE FORMING APPARATUS

FIELD OF THE INVENTION AND RELATED ART

The present invention relates to an image forming method which comprises a step of developing an electrostatic latent image formed in processes, such as electrophotography, electrostatic printing and electrostatic recording, with a magnetic toner, and an image forming apparatus therefor.

Hitherto, a large number of electrophotographic processes have been known, inclusive of those disclosed in U.S. Pat. Nos. 2,297,691; 3,666,363; and 4,071,361. In these processes, in general, an electrostatic latent image is formed on a photosensitive member comprising a photoconductive material by various means, then the latent image is developed with a toner, and the resultant toner image is, after being transferred onto a transfer material such as paper etc., as desired, fixed by heating, pressing, or heating and pressing, or with solvent vapor to obtain a copy.

Various developing methods for visualizing electrostatic images have also been known, inclusive of a class of methods wherein developing is effected under application of bias voltages, e.g., as disclosed in U.S. Pat. Nos. 3,866,574; 3,890,929; and 3,893,418.

It has been proposed to control the flying of a high-resistivity monocomponent toner between a latent image-bearing member and a toner carrying member disposed to form a spacing therebetween by applying an asymmetrical AC pulsed bias voltage. A waveform diagram of the bias voltage is shown in FIG. 7. More specifically, the latent image-bearing member and the toner-carrying member are disposed with a spacing of 50–500 microns, preferably 50–180 microns. The frequency is 1.5–10 kHz, preferably 4–8 kHz. The development time $T_A$ is set to satisfy 10 $\mu$sec $\leqq T_A \leqq$ 200 $\mu$sec, preferably 30 $\mu$sec $\leqq T_A \leqq$ 200 $\mu$sec. The peeling (or reverse development) time $T_D$ is set to satisfy 100 $\mu$sec $\leqq T_D \leqq$ 500 $\mu$sec, preferably 100 $\mu$sec $\leqq T_D \leqq$ 180 $\mu$sec. The development voltage $V_A$ and the peeling voltage $V_D$ are set to satisfy $V_A \geqq -150$ V, $V_D \geqq 400$ V, and $V_D - V_A \leqq 800$ V, preferably $-150$ V $\leqq V_A \leqq -200$ V and 400 V $\leqq V_D \leqq 450$ V. According to this system, the jumping and attachment of toner particles onto non-image parts are prevented to improve the gradation characteristic and the high-reproducibility. FIG. 8 illustrates a schematic view of toner flying in such a system.

According to a developing method as described above wherein the absolute value of AC bias voltage is suppressed to a low value and the development (−side)voltage is made small, a sufficient image density cannot be obtained in some cases.

As latent-image developing methods using a high-resistivity monocomponent toner (with a volume resistivity of $10^{10}$ ohm.cm or higher), there have been known the impression developing method (U.S. Pat. No. 3,405,682, etc.) and the jumping method (Japanese Laid-Open Patent Applications JP-A-55, 18656 - 18659, etc.). According to the jumping developing method, in a development region which is formed at the closest part between a toner-carrying member and a latent image-bearing member, a toner is reciprocally moved between the toner-carrying member and the latent image-bearing member under application of an AC bias voltage between the toner-carrying member and the latent image-bearing member to be finally transferred and attached selectively to the surface of the latent image-bearing member corresponding to a latent image pattern to visualize the latent image. The duty ratio at this time is 50%, and accordingly the development time and the reverse development time are the same.

It has been also proposed in the jumping developing method to control the duty ratio of the AC bias voltage applied between the toner-carrying member and the latent image-bearing member depending on the residual amount of the toner so as to adjust the image density (JP-A 60 73647, etc.).

In the developing methods using a high-resistivity mono-component developer, a solid latent image (high potential region) is effectively developed because of a high development side bias voltage whereas the developed toner image is liable to be peeled excessively because of a large reverse development-side bias voltage in a low potential region, thus resulting in an image lacking a gradation characteristic. Further, there is left a narrow latitude for setting the parameters for the development-side voltage (DC component and AC voltage (amplitude Vpp and frequency)). When the voltage is adjusted (by lowering the DC component or raising the AC component) so as to increase the density, a ground fog is liable to occur. An increase in AC frequency is effective for suppressing the ground fog but also functions to make thinner character or line images to result in poor reproducibility of such images.

The above-mentioned two types of developing methods can be improved by applying a higher development side bias voltage while setting a short time therefor, so that it becomes possible to obtain images which have a high image density, are rich in gradation characteristic and are free from ground fog.

When the image forming method adopting the above developing method is repetitively applied, deterioration of image qualities have been encountered in some cases, such as a lowering in image density, an increase in ground fog, or deterioration in resolution or line-reproducibility.

In a specific case where the above-mentioned difficulties were encountered, the particle size distribution of the toner remaining in the developing apparatus was examined whereby the change in particle size distribution was observed as compared with that of the initial stage and the deterioration in image qualities was found to be caused by the change in particle size distribution of the toner due to selective consumption of toner in a particular particle size range.

There are two important requirements A and B as described below in a developing method using an insulating magnetic toner. Requirement A: To form a uniform coating layer of magnetic toner on a toner-carrying member. Requirement B: To uniformly and effectively charge the magnetic toner triboelectrically. It has been hitherto tried to satisfy the requirements A and B in combination.

For the requirement A of forming a uniform layer of toner on a toner-carrying member, it has been known to dispose a coating blade at the outlet of a toner container. For example, in a developing apparatus shown in FIG. 16, a blade 24 comprising a magnetic material is disposed opposite to a magnetic pole N1 of a fixed magnet 23 enclosed within a toner-carrying member 22 to form ears of the toner along magnetic lines of force acting between the magnetic pole N1 and the magnetic blade 24 and cut the ears with the tip edge of the blade 24, thereby regulating the thickness of the resulting toner layer under the action of the magnetic force (e.g., as disclosed in JP-A-54 43037).

As for the requirement A, a method of forming a uniform toner coating layer of a magnetic toner on a toner-carrying member is also proposed by JP-A-57 66455. In the developing apparatus for effecting the method, the surface of a toner-carrying member is provided with an indefinite unevenness pattern as shown in FIG. 14 by sand-blasting the surface with irregular-shaped particles, so as to always provide a uniform toner coating state for a long period of time. The entire surface of the toner-carrying member thus treated has minute cuttings or projections disposed at random.

A developing apparatus using a toner-carrying member having such a specific surface state can result in deterioration of developing characteristics, such as fog and lower image density depending on the magnetic toner used. This is caused by occurrence of insufficiently charged toner particles in the magnetic toner leading to a lowering in electric charge of the toner layer. In some cases, other difficulties can be encountered, such as tailing, scattering, or instability of reproduction of thin lines.

As for the requirement B, in order to provide a toner-carrying member with an enhanced ability of triboelectrically charging a magnetic toner, it has been proposed to make smoother the surface of a toner-carrying member. According to such a method, however, the coating of a magnetic toner can become uniform to result in irregularities in developed images, thus failing to provide good images.

A developing method for achieving the requirements A and B in combination has been proposed (EP-A-0331425). The developing method uses a toner-carrying member having a surface subjected to blasting with definite-shaped particles in combination with a magnetic toner having a specific particle size distribution so as to be capable of forming a uniform toner coating layer for a long period.

When image formation is repeated according to the monocomponent developing system, toner particles having a small particle size can be attached to the surface of the toner-carrying member because of an image force due to their high electric charge so that triboelectrification of the other particles can be hindered. As a result, the proportion of toner particles having insufficient charge is increased to cause a lowering in image density in some cases. This phenomenon is liable to be encountered particularly under the low-humidity condition.

The above phenomenon is promoted when the toner on the toner-carrying member is not consumed, e.g., so as to provide a white ground image, and results in a decrease in image density. This phenomenon is alleviated to gradually restore an intended image density when the toner on the toner-carrying member is consumed, e.g., so as to provide a black image part.

Thus, there are formed a consumed part where the toner has been consumed and an unconsumed part where the toner has not been consumed on a toner-carrying member as a result of previous developing operation. When such a toner-carrying member having a memory of the previous developing operation is subjected to latent image formation and development, there can result in differences in tone image density, i.e., a higher density at the consumed part and a lower density at the unconsumed part.

The above-mentioned phenomenon is hereinafter called "toner-carrying member memory" or "sleeve memory". The toner-carrying member memory can be solved by the consumption of the toner on the toner-carrying member as is understood from the mechanism of the occurrence. Thus, the toner-carrying member memory is alleviated for each one rotation of the toner-carrying carrying member memory disappears from the developed image after one rotation, but a serious toner-carrying member memory repeatedly appears in several developed images.

According to our study, a toner-carrying member subjected to blasting with definite-shaped particles has better charge-imparting ability than a toner-carrying member subjected to blasting with indefinite-shaped particles and is thus more advantageous in charging a toner. In some cases, however, such a toner-carrying member is liable to excessively charge a toner to result in the toner-carrying member memory.

On the other hand, the above-mentioned latent image-bearing member may comprise a photosensitive member for electrophotography, which may for example comprise Se, CdS, an organic photoconductor (OPC), and amorphous silicon (hereinafter called "a-Si").

In recent years, a variety of electrophotographic copying machines are required for reproducing color images, for personal use, for intelligent use and for maintenance-free use. As a result, a photoconductor having a novel characteristic and a high stability has been desired and has been developed. Among them, a-Si has been calling attention.

As a-Si has high sensitivities over the entirety of visible wavelength regions so that it is also applicable to a semiconductor laser and color image formation. Moreover, it has a high surface hardness as represented by a Vickers hardness of 1500–2000 and is expected to have a long life as represented by a copying or printing durability of $10^6$ sheets or more which is several times that of a CdS photoconductor. Further, a-Si also has a sufficient heat-resistance which is satisfactory for practical use of electrophotographic copying machines.

Generally, an a-Si photosensitive member is said to have a surface dark (part) potential which depends on the thickness.

The surface dark potentials of commercially used photosensitive members are required to be 500 V at the minimum for CdS photosensitive members and 600–800 V for Se photosensitive members and OPC photosensitive members. An a-Si photosensitive member is required to have a large thickness for accomplishing such potentials in view of variation in various characteristics and possible decrease in sensitivity due to changes in environmental conditions.

As a result, such a large thickness of a-Si photosensitive member is inevitably accompanied with an increase in production cost and a decrease in production efficiency. The increase in thickness is liable to be accompanied with abnormal growth of the a-Si film and formation of a locally ununiform a-Si film, which leads to a difficulty in practical use of the a-Si photosensitive member.

In order to deal with the problem, it has been proposed to make thinner the a-Si photosensitive member so as to satisfy the productivity, production cost and performances thereof.

In order to use a thin a-Si photosensitive member, it is necessary to adopt a developing method capable of development at a low potential. While use of a thin a-Si photosensitive member is satisfactory in respects of production cost, capacity and photosensitive performances, it results in a lower surface potential, and attachment of impurities onto the surface under a high humidity condition which leads to lower photosensitive characteristics and image flow in the resultant image. A practical a-Si provides a surface dark potential of about 400 V, and the stably applicable potential is about 300 V. In such a case of a low developing contrast of 300 V between the light and dark parts, it is extremely difficult to obtain a sufficient density of solid black by an ordinary developing method. Herein, the developing contrast in normal development refers to the absolute value of a difference obtained by subtracting a developing potential from an average dark part potential over a photosensitive member. In order to effectively use a thin a-Si photosensitive member under such a condition, a novel developing method capable of developing a low potential latent image is expected.

SUMMARY OF THE INVENTION

An object of the present invention is to provide an image forming method and an image forming apparatus using an asymmetrical developing bias voltage having solved the above-mentioned problems.

A more specific object of the present invention is to provide an image forming method and an image forming apparatus which are excellent in durability and are capable of stably providing toner images having a high image density and free from white ground fog even in a long period of continuous use.

Another object of the present invention is to provide an image forming method and an image forming apparatus capable of providing toner images which are rich in gradation characteristic and excellent in resolution and thin line reproducibility.

Still another object of the present invention is to provide an image forming method and an image forming apparatus capable of stably providing toner images having a high image density even under a low humidity condition.

Another object of the present invention is to provide an image forming method and an image forming apparatus wherein a magnetic toner is uniformly applied on a toner-carrying member and is also uniformly charged stably and not excessively or not insufficiently, so that the flying of the magnetic toner is made more effective.

Another object of the present invention is to provide an image forming method and an image forming apparatus wherein the toner-carrying member memory is prevented or suppressed.

Another object of the present invention is to provide an image forming method and an image forming apparatus wherein an electrostatic latent image formed on an a-Si photosensitive member is effectively developed.

Another object of the present invention is to provide an image forming method and an image forming apparatus which are capable of providing a sufficient image even by using an a-Si photosensitive member having a low surface potential.

Another object of the present invention is to provide an image forming method and an image forming apparatus wherein even a small potential contrast on an a-Si photosensitive member can be faithfully developed to provide a gradational image.

Another object of the present invention is to provide an image forming method and an image forming apparatus wherein a delicate latent image formed on an a-Si photosensitive member is faithfully developed to provide a toner image excellent in thin line reproducibility and resolution.

A further object of the present invention is to provide an image forming method and an image forming apparatus such that a high developing speed and a high durability are realized by using an a-Si photosensitive member.

According to the present invention, there is provided an image forming method, comprising:

disposing a latent image-bearing member for holding an electrostatic image thereon and a toner-carrying member for carrying a magnetic toner with a prescribed gap at a developing station; the magnetic toner comprising a binder resin and magnetic powder and having a particle size distribution including 12% by number or more of magnetic toner particles of 5 microns or smaller, 33% by number or less of magnetic toner particles of 8–12.7 microns and 2% by volume or less of magnetic toner particles of 16 microns or larger so as to provide a volume-average particle size of 4–10 microns;

conveying the magnetic toner in a layer carried on the toner-carrying member and regulated in a thickness thinner than the prescribed gap to the developing station; and applying an alternating bias voltage comprising a DC bias voltage and an unsymmetrical AC bias voltage in superposition between the toner-carrying member and the latent image-bearing member at the developing station to provide an alternating bias electric field comprising a development-side voltage component and a reverse-development side voltage component, the development-side voltage component having a magnitude equal to or larger than that of the reverse development-side voltage component and a duration smaller than that of the reverse-development side voltage component, so that the magnetic toner on the toner-carrying member is transferred to the latent image-bearing member to develop the electrostatic image thereon at the developing station.

According to another aspect of the present invention, there is provided an image forming apparatus, comprising: a latent image-bearing member for holding an electrostatic image thereon, a toner-carrying member for carrying a layer of a magnetic toner thereon, a toner vessel for holding the magnetic toner to be supplied to the toner-carrying member, a toner layer-regulating member for regulating the magnetic toner layer on the toner-carrying member, and a bias application means for applying an alternating bias voltage comprising a DC bias voltage and an unsymmetrical AC bias voltage in superposition between the toner-carrying member and the latent image-bearing member, wherein the latent image-bearing member and the toner-carrying member are disposed with a prescribed gap therebetween at a developing station;

the toner layer-regulating means is disposed to regulate the magnetic toner layer on the toner-carrying member in a thickness thinner than the prescribed gap;

the magnetic toner comprises a binder resin and magnetic powder and has a particle size distribution including 12% by number or more of magnetic toner particles of 5 microns or smaller, 33% by number or less of magnetic toner particles of 8–12.7 microns and 2% by volume or less of magnetic toner particles of 16 microns or larger so as to provide a volume-average particle size of 4–10 microns; and the bias application means is disposed to provide an alternating bias electric field comprising a development-side voltage component and a reverse-development side voltage component, the development-side voltage component having a magnitude equal to or larger than that of the reverse development-side voltage component and a duration smaller than that of the reverse-development side voltage component, so that the magnetic toner on the toner-carrying member is transferred to the latent image-bearing member to develop the electrostatic image thereon at the developing station.

These and other objects, features and advantages of the present invention will become more apparent upon a consideration of the following description of the preferred embodiments of the present invention taken in conjunction with the accompanying drawings.

DETAILED DESCRIPTION OF THE INVENTION

A study has been made on the relationship between a toner particle size and a developing characteristic under application of a developing bias (voltage) by using magnetic toners having a particle size distribution ranging from 0.5 to 20 microns. It was intended to observe a pulse duration at which a magnetic toner began to attach to a latent image-bearing member (to provide an image density of 1.0 or above after the transfer and fixation) in a case where a certain development-side voltage (about 1000 V) in the form of a pulse was applied between a toner-carrying member and the latent image-bearing member (disposed with a spacing of about 250 microns) in connection with the particle size distribution of the toner. When a latent image was developed at a constant surface potential on the latent image-bearing member while changing the pulse duration and the magnetic toner particles used for development on the latent image-bearing member was collected for measurement of the particle size distribution thereof, it was found that there were many magnetic toner particles having a size of 8 microns or smaller and also there were many magnetic toner particles having a size of 5 microns or smaller in the case where the pulse duration was 200 μsec or shorter. When the pulse duration was made further smaller, the proportion of the magnetic toner particles of 5 microns or smaller was found to be increased. From these facts, it is understood that a magnetic toner particle having a smaller particle size reaches a latent image-bearing member in a shorter time.

Accordingly, at the time of application of a development-side bias voltage, it is possible to use a smaller magnetic toner particle selectively or preferentially for development by setting the bias to be higher and the application time to be shorter.

On the other hand, at the time of application of a reverse development-side bias voltage, by setting the (peeling) voltage to be lower and the application time to be longer, it becomes possible to surely return a large magnetic toner particle or a magnetic toner particle having a small charge (thus having a slow moving speed) to the toner-carrying member in a sufficient time. In this instance, a small magnetic toner particle attached to an image part on the latent image-bearing member is not substantially peeled because of a large image force and the low peeling voltage. In contrast thereto, a magnetic toner having a small charge attached in a small account to a nonimage part on the latent image-bearing member (a toner particle resulting in fog) due to toner scattering, etc., is returned to the toner-carrying member under the action of the peeling voltage because of a weak image force, whereby fog is prevented.

As a result, by applying a developing method using a developing bias voltage characteristic to the present invention, a toner image having a high image density can be obtained without white ground fog.

Figure 1:
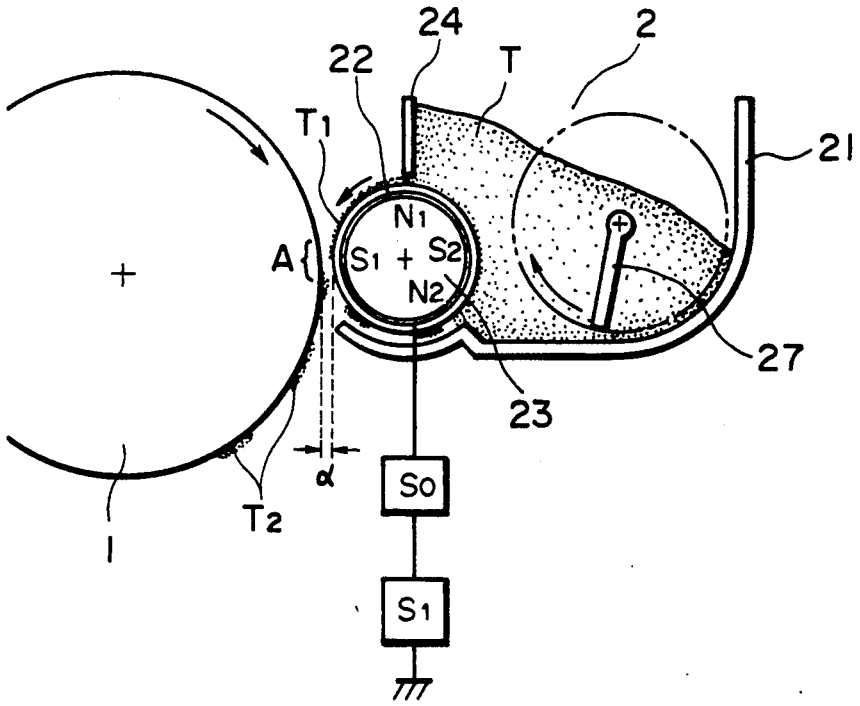
FIG. 1 is an illustration of an embodiment of the image forming apparatus according to the present invention.

The features of the present invention will now be explained with reference to FIG. 1 showing an embodiment of the image forming apparatus according to the present invention.

Referring to FIG. 1, the apparatus includes a latent image-bearing member 1 (so-called photosensitive member), such as a rotating drum, for electrophotography; an insulating member, such as a rotating drum, for electrostatic recording; photosensitive paper for the Electrofax; or electrostatic recording paper for direct electrostatic recording. An electrostatic latent image is formed on the surface of the latent image-bearing member 1 by a latent image forming mechanism or latent image forming means (not shown) and the latent image-bearing member is rotated in the direction of an indicated arrow.

The apparatus also includes a developing apparatus which in turn includes a toner container 21 (hopper) for holding a toner and a rotating cylinder 22 as a toner-carrying member (hereinafter, also called "(developing) sleeve") in which a magnetic field-generating means 23, such as a magnetic roller, is disposed.

Almost the entire right half periphery (as shown) of the developing sleeve 22 is disposed within the hopper 21 and almost the entire left hand periphery of the sleeve 22 is exposed outside the hopper. In this state, the sleeve 22 is axially supported and rotated in the direction of an indicated arrow. A doctor blade 24 as a toner layer regulating means is disposed above the sleeve 22 with its lower edge close to the upper surface of the sleeve 22. A stirrer 27 is disposed for stirring the toner within the hopper 21.

The sleeve 22 is disposed with its axis being substantially parallel with the generatrix of the latent image-bearing member 1 and opposite to the latent image-bearing member 1 surface with a slight gap therebetween.

The surface moving speed (circumferential speed) of the sleeve 22 is substantially identical to or slightly larger than that of the latent-image bearing member 1. Between the latent image-bearing member 1 and the sleeve 22, a DC voltage and an AC voltage are applied in superposition by an alternating bias voltage application means $S_0$ and a DC bias voltage application means $S_1$.

In the image forming method of the present invention, not only the magnitude of the alternating bias electric field but also the application time thereof are controlled as well as a triboelectric charge adapted to the controlling developing bias voltage. More specifically, as for the alternating bias, the frequency thereof is not changed, but the development-side bias component is increased while the application time thereof is shortened and correspondingly the reverse development-side bias component is suppressed low while the application time thereof is prolonged, thus changing the duty ratio of the alternating bias voltage.

In the present invention, the development-side bias (voltage) component refers to a voltage component having a polarity opposite to that of a latent image potential (with reference to the toner-carrying member) on the latent image-bearing member (in other words, the same polarity as the toner for developing the latent image), and the reverse development-side bias (voltage) component refers to a voltage component having the same polarity opposite as the latent image.

Figure 2:
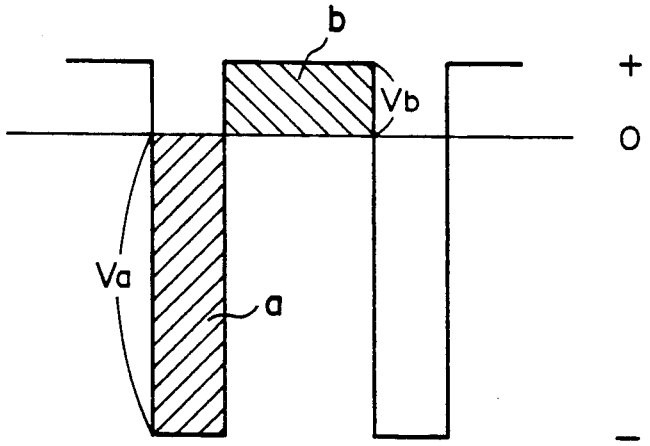
FIG. 2 is a waveform diagram illustrating bias voltage components.

For example, FIG. 2 shows an example of an unsymmetrical alternating bias voltage comprising an AC bias voltage and a DC bias voltage. FIG. 2 refers to a case where a toner having a negative charge is used for developing a latent image having a positive potential with reference to the toner-carrying member. The part a refers to a development-side bias component and the part b refers to a reverse development-side bias component. The magnitudes of the development-side component and the reverse development-side component are denoted by the absolute values of Va and Vb.

In the present invention, the duty factor of the alternating bias voltage is denoted, except for its DC bias voltage component, as follows:

$$\text{Duty factor} = t_a/(t_a + t_b)\ (\times 100)\ \%.$$

wherein $t_a$ denotes the duration of a voltage component with a polarity for directing the toner toward the latent image-bearing member of one cycle of an AC bias voltage (constituting the developing side bias component a), and $t_b$ reversely denotes the duration a voltage component with a polarity for peeling the toner from the latent image-bearing member of the AC bias voltage (constituting the reverse development-side bias component b). On the other hand, the DC bias voltage may be set between the dark part potential and the light part potential of the latent image-bearing member and may preferably be set so that the alternating bias voltage comprising the AC bias voltage and the DC bias voltage has a voltage component of the same polarity as the development-side bias component which is larger in amplitude than a component of the same polarity as the reverse development-side bias component respectively with respect to the ground level.

Almost a right half periphery of the developing sleeve 22 always contacts the toner within the hopper 21, and the toner in the vicinity of the sleeve surface is attached to and held on the sleeve surface under the action of a magnetic force exerted by the magnetic field-generating means 23 disposed in the sleeve 23 and/or an electrostatic force. As the developing sleeve 22 is rotated, the magnetic toner layer held on the sleeve is leveled into a thin toner layer $T_1$ having a substantially uniform thickness when it passes by the position of the doctor blade 24. The charging of the magnetic toner is principally effected by triboelectrification through friction with the sleeve surface and the toner stock in the vicinity of the sleeve surface caused by the rotation of the sleeve 22. The thin magnetic toner layer on the developing sleeve 22 rotates toward the latent image-bearing member 1 as the sleeve rotates and passes a developing station or region A which is the closest part between the latent image-bearing member 1 and the developing sleeve 22. In the course of the passage, the magnetic toner in the magnetic toner layer on the developing sleeve 22 flies under the action of DC and AC voltages applied between the latent image-bearing member 1 and the developing sleeve 22 and reciprocally moves between the latent image-bearing member 1 surface and the developing sleeve 22 surface in the developing region A. Finally, the magnetic toner on the developing sleeve 22 is selectively moved and attached to the latent image-bearing member 1 surface corresponding to a latent image potential pattern thereon to successively form a toner image $T_2$.

The developing sleeve surface having passed by the developing region A and having selectively consumed the magnetic toner thereon rotates back into the toner stock in the hopper 21 to be supplied again with the magnetic toner, whereby the thin toner layer $T_1$ on the developing sleeve 22 is continually moved to the developing region A when developing steps are repeatedly effected.

As described above, a problem accompanying such a developing scheme (non-contact developing method) using a monocomponent developer is that a developing performance can be decreased due to an increased force of attachment of magnetic toner particles in the vicinity of the developing sleeve surface in some cases. The magnetic toner and the sleeve always cause create friction with each other as the developing sleeve 22 rotates, so that the magnetic toner is gradually caused to have a large charge, whereby the electrostatic force (Coulomb's force) between the magnetic toner and the sleeve is increased to weaken the force of flying of the magnetic toner. As a result, the magnetic toner is stagnant in the vicinity of the sleeve to hinder the triboelectrification of the other toner particles, thus resulting in a decrease in developing characteristic. This particularly occurs under a low humidity condition or through repetition of developing steps. Due to a similar mechanism, the above-mentioned toner-carrying member memory occurs.

The force of flying the magnetic toner from the sleeve toward the latent image-bearing member 1 is required to provide an acceleration $\vec{a}$ so as to cause the magnetic toner to sufficiently reach the latent image surface under the action of an AC bias electric field. If the mass of a toner particle is denoted by m, the force $\vec{f}$ is given by $\vec{f} = m \cdot \vec{a}$. If the charge of the toner particle is denoted by q, the distance from the sleeve is denoted by d and the alternating bias electric field is denoted by $\vec{E}$, the force $\vec{f}$ is roughly given by $\vec{f} = \vec{E} \cdot q - (\epsilon \cdot \epsilon^0 \cdot q^2)/d^2$. Thus, the force of toner reaching the latent image surface is determined by a balance between the electrostatic attraction force with the sleeve and the electric field force.

In this instance, toner particles of 5 microns or smaller which are liable to gather in the vicinity of the developing sleeve can also be flied if the electric field is increased. However, if the development-side bias voltage is simply increased, the toner is caused to fly toward the latent image side regardless of the latent image pattern. This tendency is strong for toner particles of 5 microns or smaller, thus being liable to cause ground fog. The ground fog can be prevented by increasing the reverse development-side voltage, but if the alternating electric field acting between the latent image-bearing member 1 and the developing sleeve 22 is increased, a discharge is directly caused between the latent image-bearing member 1 and the sleeve 22 to remarkably impair the image quality.

Further, when the reverse development-side voltage is also increased, the toner attached not only to the non-latent image part but also to the latent image pattern (image part) is caused to be peeled. Thus, magnetic toner particles of 8–12.7 microns having a relatively small image force to the latent image-bearing member are liable to be removed so that the coverage on the latent image part becomes poor to cause image defects, such as disturbance of a developed pattern, deterioration of gradation characteristic and line-reproducibility and liability of hollow image (white dropout of a middle part of an image).

From the above results, it is important to cause the toner in the vicinity of the sleeve to fly and reciprocally move without excessively increasing the alternating bias electric field and by suppressing the reverse development-side bias voltage to a low value.

By sufficiently increasing the development-side bias electric field according to the scheme of the present invention, toner particles of 5 microns or smaller on the sleeve which constitute an essential component for improving the image quality can be effectively caused to fly and reciprocally move. As a result, it has become possible to suppress the decrease in image density and toner-carrying member memory.

As the reverse development-side bias electric field is provided with a sufficiently long duration while the magnitude thereof is suppressed, a force for peeling an excessive toner attached to outside the latent image pattern from the latent image-bearing member 1 is given so that ground fog can be prevented.

Figure 3:
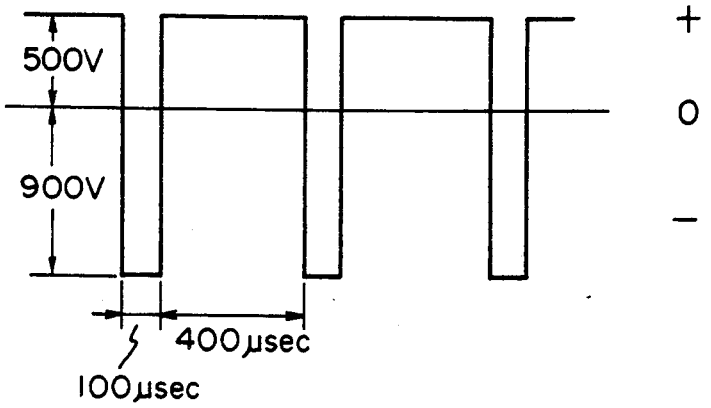
FIGS. 3–6 and FIGS. 17–21 are waveform diagrams showing alternating bias voltage waveforms according to the present invention.

At this time, as the reverse development-side electric field is suppressed to be low, toner particles of 8–12 microns which constitute an essential component of toner coverage are not peeled. FIG. 3 shows an example of the alternating bias voltage waveform used in the present invention.

The reverse development-side bias electric field is weak but the duration thereof is prolonged so that the effective force for peeling from the latent image-bearing member remains identical. The toner image attached to the latent image is not disturbed so that a good image with a gradation characteristic is attained.

The sleeve used in the present invention is excellent in triboelectricity-imparting ability to uniformly charge the magnetic toner of the invention, so that a good developing performance is attained under application of the alternating electric field for development according to the invention. As a result, a high-density image free from fog can be obtained with high image qualities, such as excellent gradation characteristic, resolution and thin-line reproducibility.

Toner particles of 5 microns or smaller are effectively consumed by the development-side bias to accomplish a high image quality and do not stick to the surface of even a specific developing sleeve as described below the present invention, so that the decrease in image density of toner-carrying member memory is not liable to occur. The same also holds true with toner particles of 8–12.7 microns. Thus, these particles are sufficiently used for development under the action of the development-side bias voltage to accomplish high image density and gradation characteristic but are not peeled from the latent image-bearing member under the action of the reverse development-side bias, so that middle dropout and disturbance of line images can be obviated.

Under the action of the developing bias voltage according to the present invention, when ears formed of a toner fly and the tips of the ears touch the latent image-bearing member, the toner particles in the neighborhood of the ear tips, particles of a small particle size and particles having a large charge are attached to the latent image-bearing member for effecting development because of the image force, whereas the particles constituting the trailing ends or particles having a small charge are returned to the toner-carrying member under the action of the reverse development-side bias. Thus, the ears tend to be broken so that difficulties such as tailing and scattering due to ears can be alleviated. As the developing sleeve and the magnetic toner used in the invention tend to form uniform and small ears, so that the effect is enhanced.

The magnetic toner having a specific particle size distribution or the sleeve having a specific surface shape according to the invention are successively supplied to latent images under the action of the developing bias according to the invention, so that shortage of toner coverage is not caused.

According to the alternating bias electric field used in the present invention, the development-side-bias electric field is so strong as to cause toner particles near the sleeve surface fly, so that toner particles having a large charge are more intensively used for development of a latent image pattern. As a result, toner particles having a large charge are firmly attached onto even a weak latent image pattern due to an electrostatic force, so that an image having a sharp edge can be obtained at a high resolution. Further, magnetic toner particles of 5 microns or smaller effective for realizing a high quality image are effectively used to provide a good image.

In the developing method used in the present invention, a satisfactory development may be effected for a gap of from 0.1 mm to 0.5 mm between the developing sleeve 22 and the latent image-bearing member 1 while 0.3 mm was representatively used in the Examples described hereinafter. This is because a higher development-side bias allows a larger gap between the developing sleeve and the latent image-bearing member than in the conventional developing method.

A satisfactory image can be obtained if the absolute value of the alternating bias voltage is 1.0 kV or higher. Taking a possible leakage to the latent image-bearing member into consideration, the peak-to-peak voltage of the alternating bias voltage may preferably be 1.0 kV or higher and 2.0 kV or lower. The leakage can of course change depending on the gap between the developing sleeve 22 and the latent image-bearing member 1.

The frequency of the alternating bias may preferably be 1.0 kHz to 5.0 kHz. If the frequency is below 1.0 kHz, a better gradation can be attained but it becomes difficult to dissolve the ground fog. This is presumably because, in such a lower frequency region where the frequency of the reciprocal movement of the toner is smaller, the force of pressing toner onto the latent image-bearing member due to the development-side becomes excessive even onto a non-image part, so that a portion of toner attached onto the non-image part cannot be completely removed by the peeling force due to the reverse development-side bias electric field. On the other hand, at a frequency above 5.0 kHz, the reverse development-side bias electric field is applied before the toner sufficiently contacts the latent image-bearing member, so that the developing performance is remarkably lowered. In other words, the toner per se cannot respond to such a high frequency electric field.

In the present invention, a frequency of the alternating bias electric field in the range of 1.5 kHz to 3 kHz provided an optimum image quality.

The duty factor of the alternating bias electric field waveform according to the present invention may be substantially below 50%, preferably be a value satisfying: 10% $\leqq$duty factor$\leqq$40%. If the duty factor is above 40%, the above-mentioned defects become noticeable to fail to achieve the improvement in image quality according to the present invention. If the duty factor is below 10%, the response of the toner to the alternating bias electric field becomes poor to lower the developing performance. The duty factor may optimally be in the range of 15 to 35% (inclusive).

The alternating bias waveform may for example be in the form of a rectangular wave, a sine-wave, a saw-teeth wave or a triangular wave.

As a test for evaluating the developing characteristic of a magnetic toner, a magnetic toner having a particle size distribution ranging from 0.5 microns to 30 microns was used for developing latent images on a photosensitive member having various surface potential contrasts ranging from a large potential contrast at which a majority of toner particles were readily used for development, through a half tone contrast and to a small potential contrast at which slight portions of toner particles were used for development. Then, the toner particles used for developing the latent images were recovered from the photosensitive member for measurement of the particle size distribution. As a result, it was found that the proportion of magnetic toner particles of 8 microns or smaller, particularly magnetic toner particles of 5 microns or smaller, was increased. It was also found that latent images were faithfully developed without enlargement and at a good reproducibility when magnetic toner particles of 5 microns or smaller most suitable for development were smoothly supplied to latent images on the photosensitive member.

A characteristic of the magnetic toner according to the present invention is that it contains 12% by number or more of magnetic toner particles having a particle size of 5 microns or smaller. Hitherto, it has been difficult to control the charge imported to magnetic toner particles of 5 microns or smaller so that these small particles are liable to be charged excessively. For this reason, magnetic toner particles of 5 microns or smaller have been considered to have a strong image force onto a developing sleeve and are firmly attached to the sleeve surface to hinder triboelectrification of the other particles and cause insufficiently charged toner particles, thus resulting in roughening of images and a decrease in image density. Thus, it has been considered necessary to decrease magnetic toner particles of 5 microns or smaller.

As a result of our study, however, it has been found that magnetic toner particles of 5 microns or smaller constitute an essential component for providing images of a high quality.

According to the developing method of the present invention, toner particles of 5 microns or smaller are effectively caused to fly and prevented from sticking onto the sleeve surface.

Another characteristic of the magnetic toner used in the present invention is that toner particles of 8–12.7 microns constitute 33% by number or less. This is related with the above-mentioned necessity of the magnetic toner particles of 5 microns or smaller. Magnetic toner particles of 5 microns or smaller are able to strictly cover and faithfully reproduce a latent image, but a latent image per se has a higher electric field intensity at the peripheral edge than the middle or central portion. As a result, toner particles are attached to the central portion in a smaller thickness than to the peripheral part, so that the inner part is liable to be thin in density. This tendency is particularly observed by magnetic toner particles of 5 microns or smaller. We have found that this problem can be solved to provide a clear image by using toner particles of 8–12.7 microns in a proportion of 33% by number or less. This may be attributable to a fact that magnetic toner particles of 8–12.7 microns are supplied to an inner part having a smaller intensity than the edge of a latent image presumably because they have a moderately controlled charge relative to magnetic toner particles of 5 microns or smaller, thereby to compensate for the less coverage of toner particles and result in a uniform developed image. As a result, a sharp image having a high density and excellent in resolution and gradation characteristic can be attained.

It is preferred that toner particles of 5 microns or smaller are contained in a proportion of 12–60% by number. Further, in case where the volume-average particle size is 6–10 microns, preferably 7–10 microns, it is preferred that the contents of the toner particles of 5 microns or smaller in terms of % by number (N %) and % by volume (V %) satisfy the relationship of $N/V = -0.04N + k$, wherein $4.5 \leqq k \leqq 6.5$, and $12 \leqq N \leqq 60$. The magnetic toner having a particle size distribution satisfying the relationship according to the present invention accomplishes a better developing performance.

We have found a certain state of presence of fine powder accomplishing the intended performance satisfying the above formula during our study on the particle size distribution with respect to particles of 5 microns or smaller. With respect to a value of N in the range of $12 \leqq N \leqq 60$, a large N/V value is understood to mean that a large proportion of particles smaller than 5 microns are present with a broad particle size distribution, and a small N/V value is understood to mean that particles having a particle size in the neighborhood of 5 microns is present in a large proportion and particles smaller than that are present in a small proportion. Within the range of 12–60 for N, an even better thin-line reproducibility and high resolution are accomplished when the N/V is in the range of 2.1–5.82 and further satisfy the above formula relationship.

Magnetic toner particles of 16 microns or larger is suppressed to be not more than 2.0% by volume. The fewer, the better.

The particle size distribution of the magnetic toner used in the present invention is described more specifically below.

Magnetic toner particles of 5 microns or smaller may be contained in a proportion of 12% by number or more, preferably 12–60% by number, further preferably 17–60% by number, of the total number of particles. If the content of the magnetic toner particles of 5 microns or smaller is below 12% by number, a portion of the magnetic toner particles effective for providing a high image quality is few and particularly, as the toner is consumed during a continuation of copying or printing-out, the effective component is preferentially consumed to result in an awkward particle size distribution of the magnetic toner and gradually deteriorates the image quality. If the content is above 60% by number, mutual agglomeration of the magnetic toner particles is liable to occur to produce toner lumps having a larger size than the proper size, thus leading to difficulties, such as rough image quality, a low resolution, a large difference in density between the contour and interior of an image to provide a somewhat hollow image.

According to our study, it has been found that magnetic toner particles of 5 microns or smaller constitute an essential component for stabilizing the volume-average particle size of the magnetic toner on the developing sleeve during a successive image forming or copying operation.

During a successive image formation, magnetic toner particles of 5 microns or smaller which are most suitable for development are consumed in a large amount, so that if the amount of the particles of this size is small, the volume-average of the magnetic toner on the sleeve is gradually increased and the mass on the sleeve M/S ($mg/cm^2$) is increased to make the uniform toner coating on the sleeve difficult.

It is preferred that the content of the particles in the range of 8–12.7 microns is 33% by number or less, further preferably 1–33% by number. Above 33% by number, the image quality becomes worse, and excess of toner coverage is liable to occur, thus resulting in an increased toner consumption. Below 1% by number, it becomes difficult to obtain a high image density in some cases. The contents of the magnetic toner particles of 5 microns or smaller in terms of % by number (N %) and % by volume (V %) may preferably satisfy the relationship of $N/V = -0.04N + k$, wherein k represents a positive number satisfying $4.5 \leqq k \leqq 6.5$, preferably $4.5 \leqq k \leqq 6.0$, and N is a number satisfying $12 \leqq N \leqq 60$. The volume-average particle size at this time may be 4–10 microns.

If $k < 4.5$, magnetic toner particles of 5.0 microns or below are insufficient, and the resultant image density, resolution and sharpness decrease. When fine toner particles in a magnetic toner, which have conventionally been considered useless, are present in an appropriate amount, they are effective for achieving closest packing of toner in development and contribute to the formation of a uniform image free of coarsening. Particularly, these particles fill thin-line portions and contour portions of an image, thereby to visually improve the sharpness thereof. If $k < 4.5$ in the above formula, such component becomes insufficient in the particle size distribution, and the above-mentioned characteristics become poor.

Further, in view of the production process, a large amount of fine powder must be removed by classification in order to satisfy the condition of $k < 4.5$. Such a process is however disadvantageous in yield and toner costs. On the other hand, if $k > 6.5$, an excess of fine powder is present, whereby the balance of particle size distribution can be disturbed during successive copying or print-out, thus leading to difficulties such as increased toner agglomeration, failure in effective triboelectrification, cleaning failure and occurrence of fog.

In the magnetic toner of the present invention, the amount of magnetic toner particles having a particle size of 16 microns or larger is 2.0% by volume or smaller, preferably 1.0% by volume or smaller, more preferably 0.5% by volume or smaller. If the above amount is larger than 2.0% by volume, these particles not only are liable to impair thin-line reproducibility but also can cause transfer failure images because coarse particles of 16 microns or larger are present after development on the photosensitive member in the form of projections above a thin toner layer to irregularize the delicate contact between the photosensitive member and a transfer paper by the medium of the toner layer, thus resulting in change in transfer conditions leading to transfer failure.

In the image forming method of the present invention, toner particles of 16 microns or larger cannot be flied onto the latent image-bearing member unless they are sufficiently charged, so that they are liable to remain on the toner-carrying member to cause a change in particle size distribution, hinder the triboelectrification of other toner particles to lower the developing performance, and disturb the shape toner ears, thus causing deterioration of image qualities.

In contrast with the magnetic toner particles of 5 microns or smaller, magnetic toner particles of 16 microns or larger are relatively less consumable in successive image formation. Accordingly, if they are contained in a proportion exceeding 2.0% by volume, the volume-average particle size of the magnetic toner on the sleeve is gradually increased to result in an increase in M/S on the sleeve, which is not desirable.

The magnetic toner used in the present invention may have a volume-average particle size of 4–10 microns, preferably 4–9 microns. This value cannot be considered separately from the above-mentioned factors.

If the volume-average particle size is below 4 microns, a problem of insufficient toner coverage on a transfer paper is liable to be caused for an image having a high image area proportion, such as a graphic image. This is considered to be caused by the same reason as the problem that the interior of a latent image is developed at a lower density than the contour. If the volume-average particle size exceeds 10 microns, a good resolution may not be obtained and the particle size distribution is liable to be changed on continuation of copying to lower the image quality even if it is satisfactory at the initial stage of copying.

The magnetic toner used in the present invention having a specific particle size distribution is capable of faithfully reproducing even thin lines of a latent image formed on the photosensitive member and is also excellent in reproducibilities in dot images, such as halftone dots and digital dots to provide images excellent in gradation and resolution. Further, even when the copying or printing out is continued, it is possible to maintain a high image quality and well develop a high-density image with a less toner consumption than a conventional magnetic toner, so that the magnetic toner of the present invention is advantageous in respect of economical factor and reduction in size of a copying machine or printer main body.

The developing method applied to the magnetic toner according to the present invention allows more effective accomplishment of the above effect.

The particle size distribution of a toner is measured by means of a Coulter counter in the present invention, while it may be measured in various manners.

Coulter counter Model TA-II (available from Coulter Electronics Inc.) is used as an instrument for measurement, to which an interface (available from Nikkaki K.K.) for providing a number-basis distribution, and a volume-basis distribution and a personal computer CX-1 (available from Canon K.K.) are connected.

For measurement, a 1%-NaCl aqueous solution as an electrolytic solution is prepared by using a reagent-grade sodium chloride. For example, ISOTON ®-II (available from Coulter Scientific Japan K.K.) may be used therefor. Into 100 to 150 ml of the electrolytic solution, 0.1 to 5 ml of a surfactant, preferably an alkylbenzenesulfonic acid salt, is added as a dispersant, and 2 to 20 mg of a sample is added thereto. The resultant dispersion of the sample in the electrolytic liquid is subjected to a dispersion treatment for about 1–3 minutes by means of an ultrasonic disperser, and then subjected to measurement of particle size distribution in the range of 2–40 microns by using the above-mentioned Coulter counter Model TA-II with a 100 micron-aperture to obtain a volume-basis distribution and a number-basis distribution. From the results of the volume-basis distribution and number-basis distribution, parameters characterizing the magnetic toner of the present invention may be obtained.

It is further preferred in view of better developing characteristic that the magnetic toner used in the present invention satisfies the condition represented by the formula (1) below:

$$2(\mu c/g)+0.5(\mu c/g)R \leqq Q(\mu c/g) \leqq 20(\mu c/g)+0.5(\mu c/g)R \quad (1).$$

wherein R is a number satisfying the relation of $4 \leqq R \leqq 10$ and representing the volume-average particle size of the magnetic toner, and Q represents the absolute value of the triboelectric charge of the magnetic toner on a developing sleeve. It is further preferred that the condition represented by the following formula (2) is satisfied:

$$4(\mu c/g)+0.5(\mu c/g)R \leqq Q(\mu c/g) \leqq 18(\mu c/g)+0.5(\mu c/g)R \quad (2).$$

In case of $Q>2+0.5$ R, magnetic toner particles of 8–12.7 microns and peeled from the latent image-bearing member under the action of the reverse development-side bias to cause a poor toner coverage, thus being liable to result in a follow image or disturbance of lines. Toner particles are less flied to be liable to provide an insufficient image density and a poor image quality.

On the other hand, in case of $Q>20+0.5$ R, magnetic toner particles of 5 microns or smaller cannot be readily flied even under the action of the development-side bias according to the present invention, so the a high image quality which is an effect of the magnetic toner particles of 5 microns or smaller cannot be realized. Further, these small particles are liable to be accumulated on the toner-carrying member to hinder the triboelectrification of the other particles, thus resulting in difficulties in respects of developing performances, such as decrease in image density, toner-carrying member memory, roughening and white ground fog.

The electric charge data of a toner layer on a developing sleeve described herein are based on values measured by the so-called suction-type Faraday cage method. More specifically, according to the Faraday cage method, an outer cylinder of a Faraday cage is pressed against the developing sleeve and the toner disposed on a prescribed area of the sleeve is sucked to be collected by the filter on the inner cylinder, whereby the toner layer weight in a unit area may be calculated from the weight increase of the filter. Simultaneously, the charge accumulated in the inner cylinder which is isolated from the exterior i measured to obtain the charge on the sleeve.

The binder resin constituting the magnetic toner used in the present invention may for example comprise the following materials.

Homopolymers or copolymers of vinyl monomers shown below: styrene; styrene derivatives, such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-nhexylstyrene, p-n-octylstyrene, p-n-nonylstyrene, p-n-decylstyrene, and p-n-dodecylstyrene; ethylenically unsaturated monoolefins, such as ethylene, propylene, butylene, and isobutylene; unsaturated polyenes, such as butadiene; halogenated vinyls, such as vinyl chloride, vinylidene chloride, vinyl bromide, and vinyl fluoride; vinyl esters, such as vinyl acetate, vinyl propionate, and vinyl benzoate; methacrylates, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate, vinyl ethers, such as vinyl methyl ether, vinyl ethyl ether, and vinyl isobutyl ether; vinyl ketones, such as vinyl methyl ketone, vinyl hexyl ketone, and methyl isopropenyl ketone; N-vinyl compounds, such as N-vinylpyrrole, N-vinylcarbazole, N-vinylindole, and N-vinyl pyrrolidone; vinylnaphthalenes; acrylic acid derivatives or methacrylic acid derivatives, such as acrylonitrile, methacryronitrile, and acrylamide; vinyl compound derivatives having a carboxylic group, such as acrylic acid, methacrylic acid, maleic acid, and fumaric acid; half esters, such as maleic acid half esters, and fumaric acid half esters; maleic anhydride, maleic acid esters and fumaric acid ester derivatives.

Further examples of the binder resin may include: polyesters, polyurethane, epoxy resin, polyvinylbutyral, rosin, modified rosin, terpene resin, phenolic resin, aliphatic or alicyclic hydrocarbon resins, aromatic petioleum resins, haloparaffins, paraffin wax, etc. These may be used singly or in mixture.

Among these, styrene-type resins, acrylic resins, and polyester resins are particularly preferred as binder resins.

In view of the anti-offset characteristic of the resultant polymer, the binder resin may further preferably be a crosslinked vinyl polymer, a crosslinked vinyl copolymer or a mixture of these polymers, obtained by using a crosslinking agent as follows:

Aromatic divinyl compounds, such as divinylbenzene and divinylnaphthalene; diacrylate compounds connected with an alkyl chain, such as ethylene glycol diacrylate, 1,3-butylene glycol diacrylate, 1,4-butanediol diacrylate, 1,5-pentanediol diacrylate, 1,6-hexanediol diacrylate, and neopentyl glycol diacrylate, and compounds obtained by substituting methacrylate groups for the acrylate groups in the above compounds; diacrylate compounds connected with an alkyl chain including an ether bond, such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate and compounds obtained by substituting methacrylate groups for the acrylate groups in the above compounds; diacrylate compounds connected with a chain including an aromatic group and an ether bond, such as polyoxyethylene(2)-2,2-bis(4-hydroxyphenyl)propanediacrylate, polyoxyethylene(4)-2,2-bis(4-hydroxyphenyl)propanediacrylate, and compounds obtained by substituting methacrylate groups for the acrylate groups in the above compounds; and polyester-type diacrylate compounds, such as one known by a trade name of MANDA (available from Nihon Kayaku K.K.). Polyfunctional crosslinking agents, such as pentaerythritol triacrylate, trimethylethane triacrylate, tetramethylolmethane tetracrylate, oligoester acrylate, and compounds obtained by substituting methacrylate groups for the acrylate groups in the above compounds; triallyl cyanurate and triallyl trimellitate.

These crosslinking agents may preferably be used in a proportion of about 0.01-5 wt. parts, particularly about 0.03-3 wt. parts, per 100 wt. parts of the other monomer components.

Among the above-mentioned crosslinking monomers, aromatic divinyl compounds (particularly, divinylbenzene) and diacrylate compounds connected with a chain including an aromatic group and an ether bond may suitably be used in a toner resin in view of fixing characteristic and anti-offset characteristic. It is preferred that at least one of these compounds is used for constituting the binder resin.

The binder resin for constituting a toner to be used for a pressure fixing system may comprise a low-molecular weight polyethylene, low-molecular weight polypropylene, ethylene-vinyl acetate copolymer, ethylene-acrylate copolymer, higher fatty acid, polyamide resin or polyester resin. These resins may be used singly or in mixture.

The magnetic toner according to the present invention comprises a magnetic material, examples of which may include: iron oxide and iron oxide containing another metal oxide, such as magnetite, maghemite, and ferrite; metals, such as Fe, Co and Ni, alloys of these metals with other metals, such as Al, Co, Cu, Pb, Mg, Ni, Sn, Zn, Sb, Be, Bi, Cd, Ca, Mn, Se, Ti, W and V, and mixtures of these materials.

The magnetic material may preferably have an average particle size of 0.1-2 microns, and magnetic properties under application of 10 k Oersted, inclusive of a coercive force of 20-150 Oersted, a saturation magnetization of 50-200 emu/g, particularly 50-100 emu/g, and a remanence of 2-20 emu/g.

The magnetic toner according to the present invention may preferably be used by adding a charge control agent internally or externally. The charge control agent may be known positive charge controllers, examples of which may include: nigrosine and its modified products, e.g., with aliphatic acid metal salts, quarternary ammonium salts, diorganotin oxides and diorganotin borates. These may be used singly or in combination of two or more species. Among these, nigrosine type compounds and quarternary ammonium salts may be particularly preferred.

Further, it is also possible to use as a positive charge control agent a homopolymer of a nitrogen-containing monomer represented by the formula:

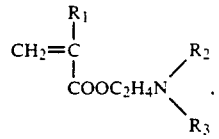

wherein $R_1$ denotes H or $CH_3$, and $R_2$ and $R_3$ respectively denote an alkyl group capable of having a substituent; or a copolymer of the nitrogen-containing monomer with another polymerizable monomer as described above, such as styrene, an acrylate or a methacrylate. The resultant nitrogen-containing homopolymer or copolymer can also function as a part or all of the binder resin.

Alternatively, in the present invention, it is also possible to use a negative charge control agent, which may be known one such as carboxylic acid derivatives or their metal salts, alkoxylates, organic metal complexes, and chelate compounds. These negative charge control agents may be used singly or in mixture of two or more species. Among these, acetylacetone metal complex, salicyclic acid metal complexes alkylsalicylic acid metal complexes, dialkylsalicyclic acid metal complexes, naphthoic acid metal complexes, and monoazometal complexes may be particularly suitably used.

The toner according to the invention can contain an arbitrary appropriate pigment or dye as a colorant as desired. The magnetic material may also function as a colorant.

The toner of the invention may further contain an additive, as desired. Examples of such an additive may include: lubricants, such as Teflon, polyvinylidene fluoride, and aliphatic acid metal salts; abrasives, such as cerium oxide, strontium titanate, and silicon carbide; fluidity-imparting agents, such as colloidal silica, alumina, and surface-treated silica and surface-treated alumina which have been treated with a surface-treating agent, such as silicone oil, various modified silicone oils, silane coupling agent, and silane coupling agent having a functional group; caking preventing agents; conductivity-imparting agents, such as carbon black and tin oxide; and fixing aids, such as low-molecular weight polyethylene. It is also possible to add a waxy substance, such as low-molecular weight polyethylene, low-molecular weight polypropylene, microcrystalline wax, carnauba wax or sasol wax in a proportion of 0.5 to 5 wt. % to the toner according to the present invention in order to provide an improved releasability of the time of hot roller fixation.

The toner used in the present invention may preferably be prepared by a method in which toner constituents are sufficiently blended in a mixer such as a ball mill and then kneaded well in a hot kneading means, such as a kneader or extruder, mechanically crushed and classified. Alternatively it is possible to use a method wherein a binder resin solution containing other components dispersed therein is spray-dried; a polymerization method wherein prescribed ingredients are dispersed in a monomer constituting a binder resin and the mixture is emulsified, followed by polymerization of the monomer to provide a polymer; etc. The toner used in the present invention can be in the form of a microcapsule toner comprising a core material and a shell material.

In the present invention, it is particularly preferred to use as a latent image-bearing member a photosensitive member comprising an a-Si photosensitive layer on a conductive substrate in applying the bias conditions according to the present invention.

Such an a-Si photosensitive member can be provided with a lower charge injection-prevention roller below the photosensitive layer so as to prevent charge injection from the substrate.

It is further possible to provide a surface protective layer above the photosensitive layer in order to improve the durability and provide an upper charge injection-preventing layer above the photosensitive layer or between the surface protective layer and the photosensitive layer.

It is also possible to dispose a layer which functions as both a surface protective layer and an upper charge injection-preventing layer.

It is also possible to dispose a long-wavelength light-absorbing layer above or below the lower charge injection-preventing layer in order to prevent interference with long-wavelength light.

In this instance, so as to adapt the respective layers to their practical use, it is possible to introduce various atoms inclusive of: hydrogen atom; Group III atoms of the periodic table, such as boron, aluminum, and gallium; Group IV atoms of the periodic table, such as germanium and tin; Group V atoms of the periodic table, such as nitrogen, phosphorus and arsenic; Group VI atoms of the periodic table, such as oxygen, sulfur, and selenium; and halogen atoms, such as fluorine, chlorine, and bromine, along or in combination at the time of formation of a-Si.

For example, a photosensitive drum for holding a negatively charged electrostatic image can be prepared by forming a photosensitive layer with hydrogenated (i.e., hydrogen-containing) a-Si, a lower charge injection-preventing layer with hydrogenated a-Si doped with phosphorus, and an upper charge injection-preventing layer with hydrogenated a-Si doped with boron.

On the other hand, a photosensitive drum for holding a positively charged electrostatic image can be prepared by forming a lower charge injection-preventing layer with hydrogenated a-Si doped with boron and a surface protective layer with an amorphous film comprising silicon, carbon and hydrogen (hereinafter called a-SiC film).

An a-Si photosensitive member is generally excellent in heat resistance and abrasion resistance and is thus excellent in durability. Accordingly, the image forming method according to the present invention is advantageous for realization of a high-speed image forming apparatus. Further, it is possible to form a latent image faithful to an original image so that it is advantageous in realizing a high image quality in an image forming apparatus such as a copying machine.

An Se photosensitive member and an OPC photosensitive member can cause deterioration of the photosensitive layer during a continuous use due to white reflection light, laser light and mechanical action to result in difficulties, such as decrease in photoconductivity and chargeability and increase in dark decay, so that they can fail to show sufficient electrophotographic performances in some cases. In such cases, there can arise difficulties such that a sufficient dark potential can not be attained, it becomes impossible to lower the light part potential to a necessary level, and it becomes difficult to obtain an appropriate potential contrast or a latent image potential corresponding to an original. As a result, an insufficient density, fog and loss of gradation can occur. The deterioration is accelerated if a larger number of image forming cycles are repeated in a unit period of time, so that the above difficulties are pronounced in a high-speed machine. Accordingly, in order to obtain stable electrostatic latent images, an a-Si photosensitive member capable of always maintaining a constant latent image potential is advantageous and such as a-Si photosensitive member can be applied to a high-speed machine without problem.

Further, an Se photosensitive member and an OPC photosensitive member can cause a disturbance in thin or fine latent images for the above-mentioned reason. The magnetic toner used in the present invention is capable of faithfully developing even thin latent images so that such a disturbance in latent image can be reflected in a developed image, thus being disadvantageous in delicate expression of thin lines and dots. On the other hand, an a-Si photosensitive member does not cause a disturbance in latent image so that the above-mentioned problems are not caused. The problems are also pronounced at a higher process speed. The magnetic toner used in the present invention has a large specific surface area, so that it has a tendency to cause a frequency contact to accelerate the abrasion of the photosensitive member when applied to a high-speed machine. Se and OPC photosensitive members are particularly liable to be abraded to promote the problem. However, an a-Si photosensitive member has a high hardness so that it is not concerned with such a problem.

In the present invention, by controlling not only the magnitude but also the duration t of an AC bias electric field, a portion of the magnetic toner capable of faithfully developing a latent image on an a-Si photosensitive member is effectively flied to accomplish the object of present invention in a satisfactory manner.

More specifically, in the present invention, an AC bias voltage is controlled so that the magnitude of the developing-side bias electric field is increased and the duration thereof is shortened without charging the entire frequency of the AC bias voltage. Corresponding thereto, the reverse development-side bias electric field is suppressed to be low and the duration thereof is increased, whereby the duty ratio of the AC bias voltage is controlled.

By sufficiently increasing the development-side bias electric field according to the above control scheme, toner particles of 5 microns or smaller on the sleeve which constitute an essential component for providing an improved image quality are effectively flied reciprocally to fully develop a latent image on an a-Si photosensitive member and prevent the sticking thereof onto the sleeve surface, whereby the decrease in image density and toner-carrying member memory are suppressed.

Further, while the reverse-development side electric field is suppressed to be low, the duration thereof is sufficiently prolonged, so that an excess of toner attached to outside a latent image pattern on an a-Si photosensitive member is supplied with a peeling force from the latent image-bearing member 1 to suppress the ground fog.

At this time, the reverse development-side electric field is suppressed to be low, so that toner particles of 8–12.7 microns constituting an essential component for toner coverage are not peeled.

While the reverse development-side bias electric field is suppressed to be low, the duration thereof is made longer, so that the effecting peeling force from the latent image-bearing member is ensured. However, the toner image attached to a latent image pattern is not disturbed, whereby a good image quality with gradation can be realized.

According to the present invention, the development-side bias electric field of an AC bias voltage is intensified to fly a portion of the toner present in the vicinity of the sleeve, so that such a portion of the toner in the vicinity of the sleeve and having a large charge is more intensively attached to a latent image pattern. As a result, even to a weak latent image pattern on an a-Si photosensitive member, such a portion of the toner having a large charge is attached because of a large electrostatic force, whereby an image having an edge sharpness and a good resolution can be obtained, and magnetic toner particles of 5 microns or smaller which are an effective component for realizing a high image quality are effectively utilized to provide an extremely good image quality.

A latent image on an a-Si photosensitive member has a low surface potential but has a large capacitance, so that the charge thereof is large. Accordingly, the magnetic toner according to the present invention is small in particle size and has a large charge, so that it is firmly attached to the latent image. The toner thus attached to a latent image part having a potential to be developed (image part) is not affected by the exterior and the image thereof is not disturbed.

As for a non-image part, a fog toner even on an a-Si photosensitive member can be peeled by the developing bias according to the present invention. As for a latent image on an a-Si photosensitive member, the magnetic toner is effectively flied under application of the above-mentioned specific bias voltage, so that a high image quality can be stably attached for a long period and the image quality is stable even under a continual use in a high-speed machine.

In the case where an a-Si photosensitive member is used as the latent image-bearing member, the above-mentioned effect of the present invention can be remarkably exhibited if the development is performed under a small difference between the light part potential and the dark part potential of 250–400 V, preferably 250–350 V.

Then, a developing sleeve used in a preferred embodiment of the present invention will be explained.

In the present invention, the developing sleeve may preferably have a surface unevenness comprising sphere-traced concavities. The surface state can be obtained by blasting with definite shaped particles. Herein, the definite-shaped particles may preferably be spherical or spheroidal particles having a substantially smoothly curved surface and having a ratio of longer axis/shorter axis of 1–2, preferably 1–1.5, further preferably 1–1.2. The regularly shaped (or definite-shaped) particles may for example be various solid spheres or globules, such as those of metals such as stainless steel, aluminum, steel, nickel and bronze, or those of ceramic, plastic or glass beads, respectively, having a specific particle size. By blasting the sleeve surface with such regularly-shaped particles having a specific particle size, it is possible to form a plurality of sphere-traced concavities having almost the same diameter R.

In the present invention, the plurality of sphere-traced concavities on the sleeve surface may preferably have a diameter R of 20 to 250 microns. If the diameter R is smaller than 20 microns, the soiling with a magnetic toner component is increased. On the other hand, a diameter R of over 250 microns is not preferred because the uniformity of toner coating on the sleeve is lowered. As a result, the definite-shaped particles used in blasting of the sleeve surface may preferably have a diameter of 20–250 microns. The definite shaped particles can have a particle size distribution as far as the above-mentioned R and the pitch P and roughness d of the sleeve surface as described hereinbelow are satisfied.

In the present invention, the pitch P and the surface roughness d of the unevenness on a sleeve surface are based on measured values of roughness of the sleeve obtained by using a micro-surface roughness meter (commercially available from, e.g., Taylor-Hopson Co., and Kosaka Kenkyusho K.K.), and the surface roughness d is expressed in terms of a 10 point-average roughness (Rz) (JIS B 0601).

Figure 13:
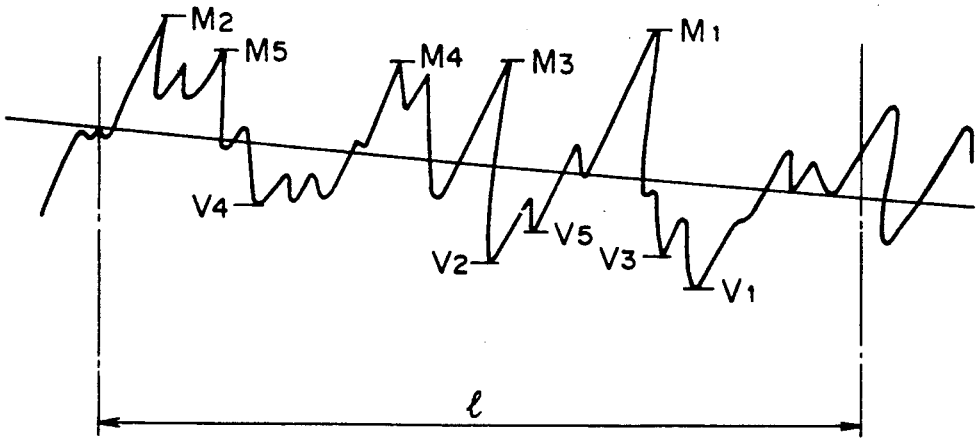
FIG. 13 is an illustration of measurement of sleeve surface roughness.

More specifically, FIG. 13 shows an example of a surface section curve, from which a portion with a standard length l is taken. In the portion, an average line is drawn as shown in FIG. 13, and then two lines each parallel with the average line are taken, one passing through a third highest peak ($M_3$) and the other passing through a third deepest valley or bottom ($V_3$). The 10 point-average roughness ($R_z$ or d) is measured as the distance between the two lines in the unit of microns (micro-meters), and the standard length l is taken as 0.25 mm. The pitch P is obtained by counting the number of peaks having a height of 0.1 micron or higher with respect to the bottoms on both sides thereof and defined as follows: P=250 (microns)/(the number (n) of the peaks in the length of 250 (microns)).

In the present invention, the pitch P of the roughness on the sleeve surface may preferably be 2 to 100 microns. A pitch P of less than 2 microns is not preferred because the soiling of the sleeve with toner component is increased. On the other hand, a pitch P in excess of 100 microns is not preferred because the uniformity of toner coating on the sleeve is lowered. The surface roughness d of the roughness on the sleeve surface may preferably be 0.1 to 5 microns. A roughness d in excess of 5 microns is not preferred because an electric field is liable to be concentrated at uneven portions to cause disturbance in images in a system wherein an alternating voltage is applied between the sleeve and the latent image-holding member to cause jumping of the magnetic toner from the sleeve side onto the latent image surface. On the other hand, a roughness d of less than 0.1 micron is not preferred because the uniformity of toner coating on the sleeve is lowered.

In the case of applying both blasting with indefinite-shaped particles and blasting with definite-shaped particles, it is necessary to leave an appropriate degree of roughness but depress fine and sharp projections formed with the indefinite-shaped particles.

Accordingly, it is preferred to first blast a sleeve surface with indefinite-shaped particles and then blast the same sleeve surface again with definite-shaped particles.

It is preferred that the definite-shaped blasting particles are larger than the indefinite-shaped blasting particles, preferably with the former being 1-20 times, the size of particularly 1.5-9 times, the latter.

In the latter blasting with definite-shaped particles, it is preferred to set at least one of the blasting time and the impinging force with the particles to be smaller than that with the indefinite-shaped particles.

As a result of our study on the roughness of a developing sleeve and the performance thereof, we have found the following.

Hereinbelow, a developing sleeve obtained by blasting with indefinite-shaped particles is referred to as Sleeve A, a developing sleeve obtained by blasting with definite-shaped particles is referred to as Sleeve B, and a developing sleeve obtained by blasting with both indefinite-shaped particles and definite-shaped particles is referred to as Sleeve C. The roughness states of the respective sleeves thus obtained are represented by schematic views including FIG. 14 (Sleeve A for comparison), FIG. 11 (Sleeve B according to the invention) and FIG. 12 (Sleeve C according to the invention).

In respect of the toner coating stability on the sleeve, Sleeve A and Sleeve C are excellent. Depending on the toner and conditions for use, Sleeve B is somewhat inferior. This may be attributable to a factor that a surface with a sharp roughness is more suitable regarding conveying ability.

In respect of triboelectric charge-imparting ability, Sleeve B and Sleeve C are excellent, and Sleeve B is particularly excellent. This is because a smoother sleeve surface has a more effective triboelectrification ability.

Accordingly, toners on Sleeve B and Sleeve C are uniformly triboelectrically charged to be stably provided with a sufficient charge. Depending on the toner and operation conditions used, however, there can arise an excessive charge leading to a decrease in image density and toner-carrying member memory with respect to Sleeve B and Sleeve C. This liability is more pronounced for Sleeve B, which can cause toner-coating irregularity because of an excessive charge in some cases.

As a whole, Sleeve B and Sleeve C are excellent in balance of toner coating stability and triboelectric charge-imparting ability. Sleeve C is particularly excellent in this respect.

Incidentally, a developing sleeve is coated with magnetic toner particles forming ears (chains of magnetic toner particles formed under a magnetic field).

At the time of development, no individual particles are flied separately but the magnetic toner particles are flied while maintaining their ear forming state. Accordingly, when a latent image is developed, the developed image quality can be affected by the shape of ears. A long ear and/or a thick ear can lead to image defects, such as tailing, scattering and collapse, thus resulting in lowered resolution and thin-line reproducibility.

The ear formation is affected by amount of charge and size of toner particles. For example, if toner particles are uniformly and sufficiently charged, ears having uniform length and thickness are formed to provide an improved image quality.

The magnetic toner used in the present invention having a specific particle size distribution forms ears which are thin, short and dense (per unit area), thus being effective for improving the image quality.

On the other hand, if toner particles are ununiformly charged to contain insufficiently charged toner particles, this not only leads to fog but also disturbs ear formation to result in a mixture of long, short, thick and thin ears, thereby lowering the image quality.

In case where toner particles are not sufficiently charged to cause a low toner charge as a whole, this result in not only disturbance in ears but also sparsely formed ears, so that a high image density cannot be expected. On the other hand, if toner particles are excessively charged, particles not forming ears are attached to the sleeve surface or abnormally dense ears are formed, to cause a toner coating irregularity.

In the case of Sleeve A, there are formed sharp projections on the surface, so that the toner particles contact the sleeve surface less frequently to result in poorly charged particles and disturbed ears, thus leading to adverse effects to the image quality. The increase in charge of toner particles at the initial stage is slow to provide sparse ears and can cause low image density and fog at the initial stage. Further, depending on a toner, the toner layer is not provided with a sufficient charge without any increase to provide a continually low density state in some cases. From also this point, it is also rare for Sleeve A to cause a toner coating failure due to excessive charge, thus providing a toner coating stability.

In the cases of Sleeve B and Sleeve C, they have smooth surfaces, so that triboelectrification between the toner particles and the sleeve is effectively performed to provide the toner with a uniform and sufficient charge, thus forming uniform and dense ears to provide a high image quality. The increase in charge of toner particles is quick so that a high density image free from fog is obtained from the initial stage. On the other hand, while they are excellent in triboelectric charge-imparting ability, they are liable to excessively charge a toner. The magnetic toner used in the present invention has the tendency so that, unless small particles having a high charge are effectively consumed at the time of development, they stick to the vicinity of the sleeve to cause the above-mentioned difficulties of decrease in density and toner-carrying member memory.

Sleeve B has a particularly large charge imparting ability to provide toner particles with a large triboelectric charge, so that the above difficulties are liable to be caused. Thus, toner particles can be locally attached and abnormally dense ears are formed to cause a sleeve coating irregularity. This is particularly pronounced when toner particles of 16 microns or larger are prevalent.

In the case of Sleeve C, sharp and fine projections formed by blasting with indefinite-shaped particles are depressed by blasting with definite-shaped particles to be provided with a moderately smooth surface, so that the charge-imparting ability is improved and a toner can be effectively charged triboelectrically. Further, as the roughness given by the blasting with indefinite-shaped particles remains to a certain extent, the toner-conveying ability is retained to effect a uniform toner coating. Further, excessive triboelectrification is prevented and thus difficulties accompanying the excessive charge are alleviated with respect to decrease in image density and toner-carrying member memory or prevented with respect to toner coating irregularity.

Accordingly, the effect of improved image quality by using the magnetic toner according to the present invention is promoted by formation of more uniform ears on the toner-carrying member.

A characteristic of the magnetic toner according to the present invention is that it has a volume-average particle size of 4–10 microns. A developing sleeve (Sleeve B) according to the present invention has a specific surface unevenness comprising a plurality of sphere-traced concavities. As a result of experiment, the developing sleeve showed a somewhat inferior performance in forming a uniform magnetic toner coating layer compared with a developing sleeve (Sleeve A) having a surface unevenness formed by blasting with indefinite-shaped particles in a case where a toner having a volume-average particle size exceeding 11 microns was used in a specific environment. More specifically, when a magnetic toner having a volume-average particle size exceeding 11 microns was charged in three developing apparatuses having Sleeve A, Sleeve B and Sleeve C, respectively, in a specific environment of a temperature of below 15° C. and a humidity of below 10%, and subjected to blank rotation, whereby the respective apparatus provided a toner coating layer weight per unit area M/S (g/cm$^2$) of 1.6–2.3 mg/cm$^2$ for Sleeve B, 1.0–2.0 mg/cm$^2$ for Sleeve C, and 0.6–1.5 mg/cm$^2$ for Sleeve A. Thus, Sleeve B provided the largest thickness of toner coating layer and was found to cause a toner coating irregularity on further continuation of blank rotation for a longer period.

As a result of a further investigation of ours, however, while the reason has not been clarified as yet, when similar experiments were performed by using a magnetic toner having a volume-average particle size of 4–10 microns, even Sleeve B was formed to provide a suppressed coating thickness at M/S of 0.7–1.5 mg/cm$^2$. Further, even on continuation of blank rotation for a long period, coating irregularity did not occur, so that the decrease in toner coating thickness was formed to be very effective in uniformization of toner coating for a long term.

By using a magnetic toner having a specific particle size distribution, Sleeve B provided a toner coating stability comparable to that of Sleeve C. However, Sleeve B still showed a somewhat inferior toner coating stability than Sleeve C when a toner having a higher chargeability was used.

In the present invention, "thin-line reproducibility" was evaluated in the following manner. An original of a thin line image having a width of accurately 100 microns is copied under suitable copying conditions to provide a sample copy for measurement. The line width of the toner image on the copy is measured on a monitor of Luzex 400 Particle Analyzer. The line width is measured at several points along the length of the thin line toner image so as to provide an appropriate average value in view of fluctuations in width. The value of thin line reproducibility (%) is calculated by the following formula:

$$\frac{\text{Measured line-width of a copy image}}{\text{Line width (100 } \mu\text{m) on the original}} \times 100$$

In the present invention, the resolution was evaluated in the following manner. An original sheet having 10 original line images each comprising 5 lines spaced from each other with an identical value for line width and spacing is provided. The 10 original images comprise the 5 lines at pitches of 2.8, 3.2, 3.6, 4.0, 4.5, 5.0, 5.6, 6.3, 7.1, 8.0. 9.0 and 10.0 lines/mm, respectively. The original sheet is copied under suitable conditions to obtain a sample copy on which each of the ten line images is observed through a magnifying glass and the maximum number of lines (lines/mm) of an image in which the lines can be discriminated from each other is identified as a resolution measured. A larger number indicates a higher resolution.

Hereinbelow, the present invention will be explained in more detail based on Examples. Hereinbelow, "part(s)" used for describing a formation or composition are by weight.

First of all, production of sleeves used in image forming apparatus for accomplishing the image forming method according to the present invention will be explained.

PRODUCTION EXAMPLE 1

A stainless steel sleeve (SUS 304) in the form of a 32 mm-dia. cylinder containing a magnet therein was provided, and the surface thereof was blasted with indefinite-shaped $Al_2O_3$ particles #400 (particle size: 35–45 microns) under the conditions of a blast nozzle diameter of 7 mm, a distance of 150 mm, an air pressure of 3.5 kg/cm$^2$, and a blasting time of 60 sec., whereby Sleeve No. 1 (Reference Example) was obtained.

Figure 14:
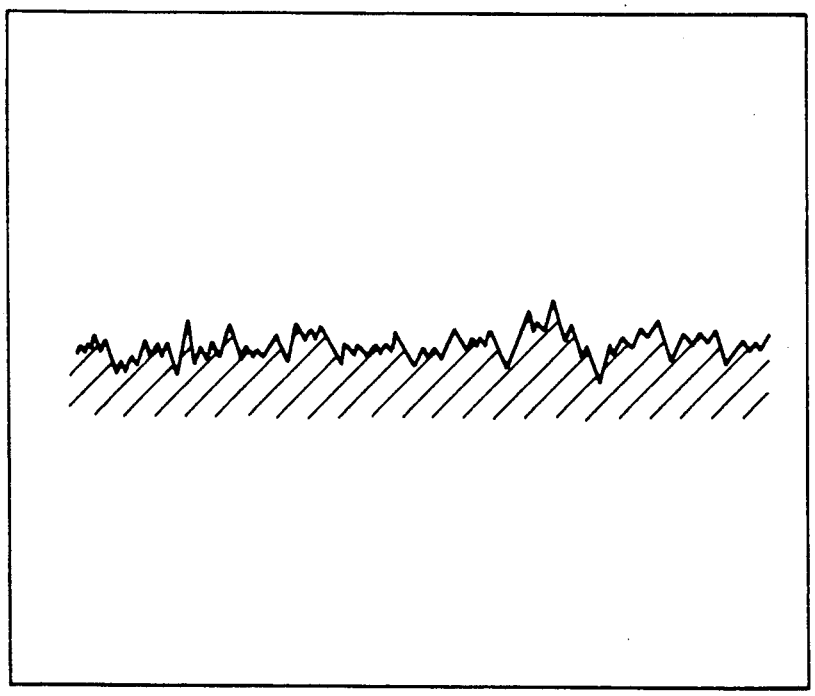

A partial surface section of Sleeve No. 1 is schematically shown in FIG. 14.

PRODUCTION EXAMPLE 2

Sleeve No. 2 (present invention) was prepared in the same manner as in Production Example 1 except that the blasting was effected by using definite shaped glass (true spheres having a long axis/short axis ratio of substantially 1.0) of #300 (53–62 microns).

The surface concavities on the surface of Sleeve No. 2 showed an unevenness pitch P of 33 microns originated from the diameter R of 53–62 microns of the definite shaped particles and a surface roughness d of 2.0 microns.

Figure 11:
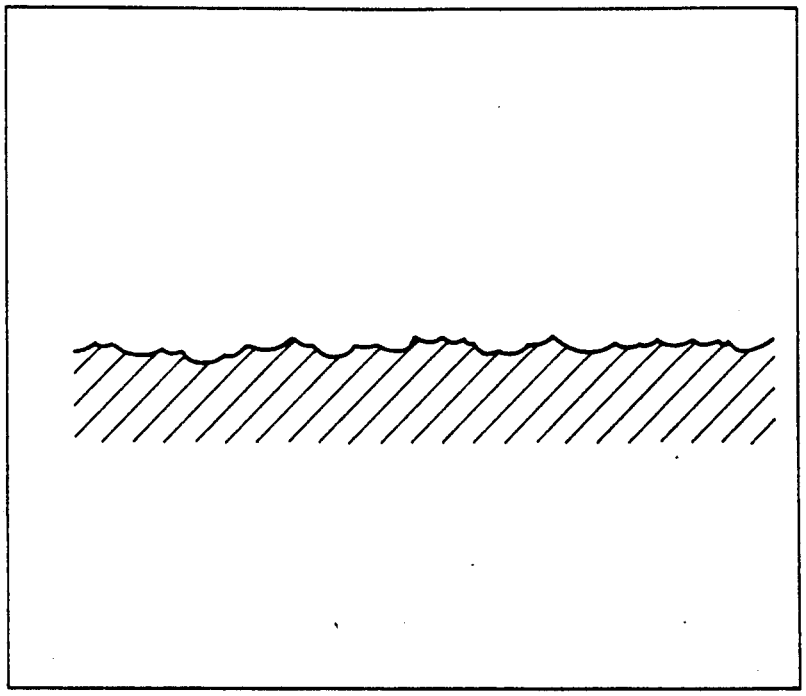
FIG. 11, 12 and 14 are illustrations of roughness states of sleeve surfaces.

A partial surface section of Sleeve No. 2 is schematically shown in FIG. 11.

PRODUCTION EXAMPLE 3

Sleeve No. 3 (present invention) was prepared by further blasting the surface of Sleeve No. 1 prepared in Production Example 1 with definite-shaped glass beads (true sphere) of #100 (150–180 microns) under the same blasting conditions as in Production Example 1 except that the air pressure was changed to 3.0 kg/cm$^2$.

Figure 12:
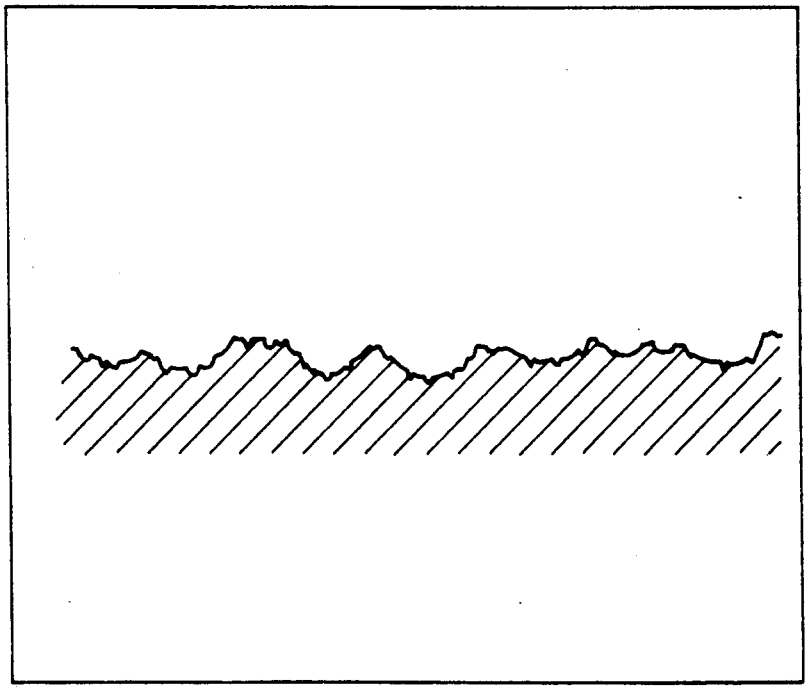

A partial surface section of Sleeve No. 3 is schematically shown in FIG. 12.

PRODUCTION EXAMPLE 4

Sleeve No. 4 (present invention) was prepared by further blasting the surface of Sleeve No. 1 prepared in Production Example 1 with definite-shaped glass beads (true sphere) of #200 (70–90 microns) under the same blasting conditions as in Production Example 1 except that the blasting time was changed to 30 sec.

PRODUCTION EXAMPLE 5

Sleeve No. 5 (present invention) was prepared in the same manner as in Production Example 1 except that the blasting was effected by using definite shaped glass (true spheres) of #100 (150–180 microns).

The surface concavities on the surface of Sleeve No. 5 showed an unevenness pitch P of 52 microns originated from the diameter R of 150–180 microns of the definite shaped particles and a surface roughness d of 2.2 microns.

PRODUCTION EXAMPLE 6

Sleeve No. 6 (present invention) was prepared by further blasting the surface of Sleeve No. 1 prepared in Production Example 1 with the definite shaped particles (#300) used in Production Example 2 under the same blasting conditions as in Production Example 1.

Then, a specific image forming apparatus used for accomplishing the image forming method according to the present invention will be described.

Referring to FIG. 1, a selenium photosensitive drum was used as the latent image-bearing member 1, the gap $\alpha$ between the latent image-bearing member 1 and the developing sleeve (toner-carrying member) 22 was set at 0.3 mm, and the gap between the developing sleeve 22 and the magnetic doctor blade 24 was set at 0.25 mm to form a magnetic toner layer thickness of about 120 microns on the developing sleeve. The magnetic field given by the magnet roller 23 as measured on the sleeve surface was 1000 gauss at the $N_1$ pole, 1000 gauss at the $S_1$ pole, 750 gauss at the $N_2$ pole and 550 gauss at the $S_2$ pole. A copying test was performed at a rate of 50 sheets (A4)/min.

Examples of the developing power supply used in the image forming apparatus of the present invention are explained particularly regarding their waveforms of the AC electric field.

WAVEFORM EXAMPLE 1

A developing bias power supply (Supply 1) capable of supplying an alternating bias voltage as shown in FIG. 3 was formed by superposing an AC voltage supply $S_0$ (Vpp (peak-to-peak voltage) = 1400 V, f (frequency) = 2000 Hz, and D.F. (duty factor) = 20%) with a DC voltage supply $S_1$ of +200 V.

WAVEFORM EXAMPLE 2

Figure 4:
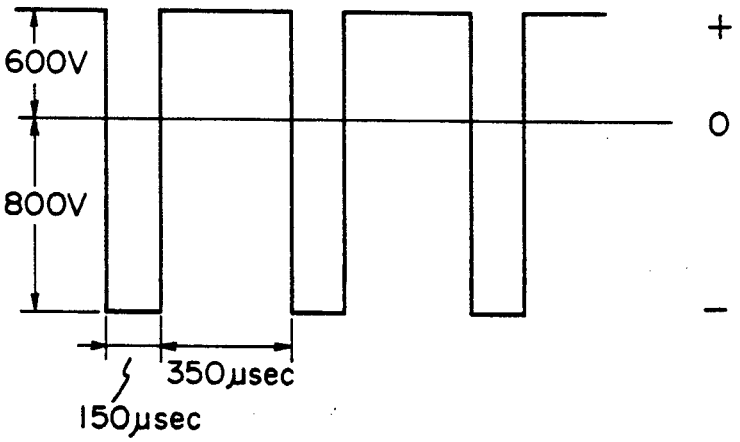

A developing bias power supply (Supply 2) capable of supplying an alternating bias voltage as shown in FIG. 4 was formed by superposing an AC voltage supply $S_0$ (Vpp = 1400 V, f = 2000 Hz, and D.F. = 30%) with a DC voltage supply $S_1$ of +200 V.

WAVEFORM EXAMPLE 3

Figure 5:
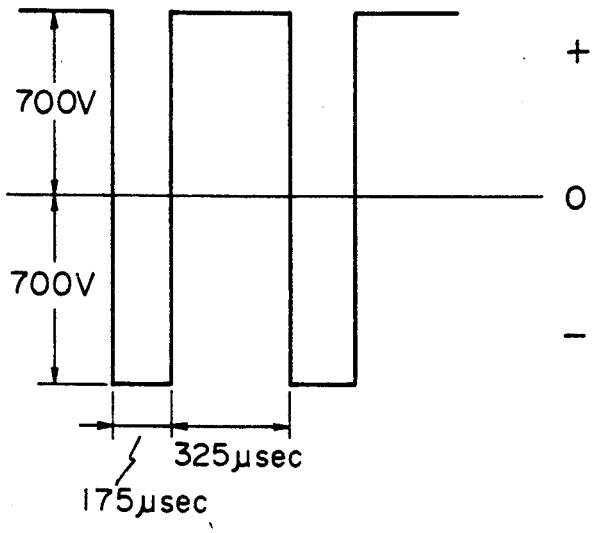

A developing bias power supply (Supply 3) capable of supplying an alternating bias voltage as shown in FIG. 5 was formed by superposing an AC voltage supply $S_0$ (Vpp = 1400 V, f = 2000 Hz, and D.F. = 35%) with a DC voltage supply $S_1$ of +200 V.

WAVEFORM EXAMPLE 4

Figure 6:
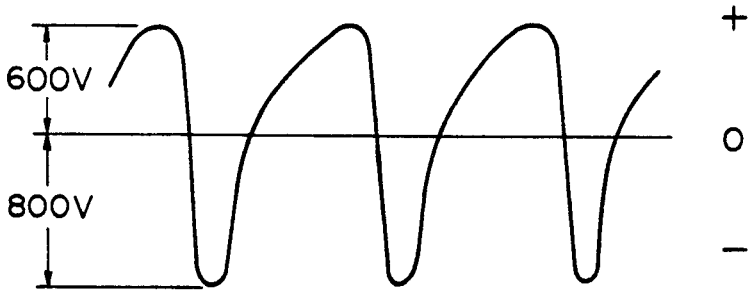
Figure 7:
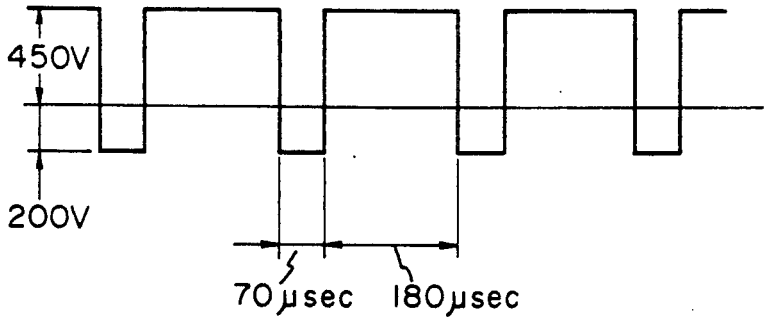
FIGS. 7, 9, 10 and 22 are waveform diagrams showing alternating bias voltage waveforms for comparison.
Figure 8:
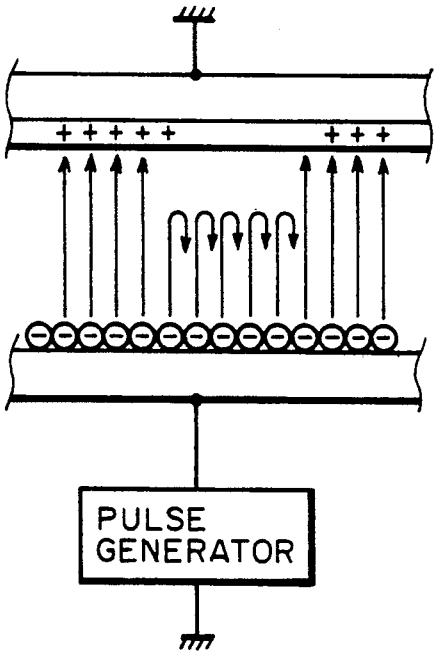
FIG. 8 is a schematic illustration of flying and attachment of toner according to the prior art method.

A developing bias power supply (Supply 4) capable of supplying an alternating bias voltage as shown in FIG. 6 was formed by superposing an AC voltage supply $S_0$ (Vpp = 1400 V, f = 2000 Hz, and D.F. = 30%) with a DC voltage supply $S_1$ of +200 V.

WAVEFORM EXAMPLE 5

Figure 9:
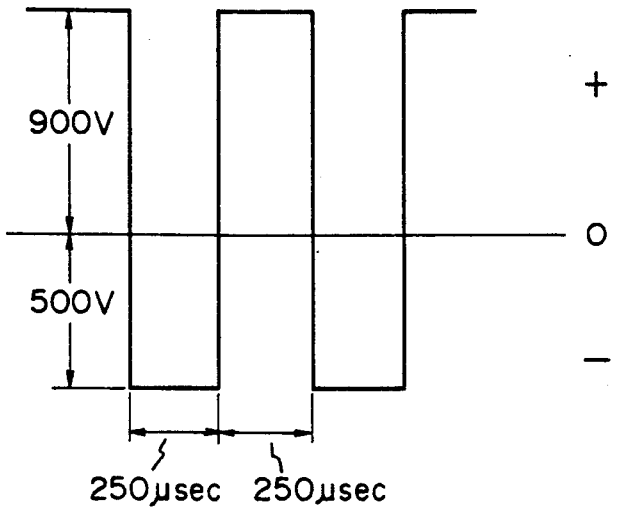
Figure 10:
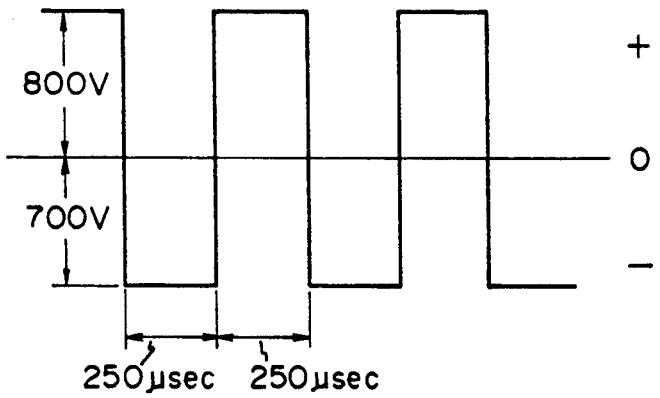

A developing bias power supply (Supply 5 for comparison) capable of supplying an alternating bias voltage as shown in FIG. 9 was formed by superposing an AC voltage supply $S_0$ (Vpp = 1400 V, f = 2000 Hz, and D.F. = 50%) with a DC voltage supply $S_1$ of +200 V.

Then, specific examples of magnetic toner used in the image forming apparatus according to the present invention will be explained.

TONER PRODUCTION EXAMPLE 1

| | |
|---|---|
| Styrene/butyl acrylate/divinyl benzene copolymer (copolymerization wt. ratio: 80/19.5/0.5, Mw (weight-average molecular weight): $3 \times 10^4$) | 100 wt. parts |
| Tri-iron tetraoxide $\overline{D}n$ ((number-average particle size) = 0.2 micron, $\sigma_{sat}$ (saturation magnetization) = about 80 emu/g, $\sigma_r$ (remanence) = about 11 emu/g, Hc (coercive force) = about 120 Oe (Oersted)) | 80 wt. parts |
| Low-molecular weight propylene-ethylene copolymer | 3 wt. parts |
| Monoazo chromium complex (charge control agent) | 2 wt. parts |

The above ingredients were well blended in a blender and melt-kneaded at 150° C. by means of a two-axis extruder. The kneaded product was cooled, coarsely crushed by a cutter mill, finely pulverized by means of a pulverizer using jet air stream, and classified by a fixed-wall type wind-force classifier (DS-type Wind-Force Classifier, mfd, by Nippon Pneumatic Mfg, Co. Ltd.) to obtain a classified powder product. Ultra-fine powder and coarse power were simultaneously and precisely removed from the classified powder by means of a multi-division classifier utilizing a Coanda effect (Elbow Jet Classifier available from Nittetsu Kogyo K.K.), thereby to obtain negatively chargeable insulating black fine powder (magnetic toner). The particle size distribution of the magnetic toner is shown in Table 1 appearing hereinafter.

Then, 100 parts of the thus obtained magnetic toner and 0.6 part of negatively chargeable hydrophobic dry process silica fine powder (BET specific surface area = 300 $m^2/g$) were blended in a Henscel mixer to prepare a magnetic toner in which the silica fine powder was attached to the toner particle surfaces. The magnetic toner in this mixture state is referred to as Magnetic toner No. 1.

TONER PRODUCTION EXAMPLE 2

| | |
|---|---|
| Crosslinked polyester resin (Mw = $6 \times 10^4$) | 100 parts |
| Magnetic iron oxide ($\overline{D}n$ = about 0.15 $\mu$m, $\sigma_{sat}$ = 90 emu/g, $\sigma_r$ = about 6 emu/g, Hc = about 70 Oe) | 100 parts |
| Low-molecular weight ethylene-propylene copolymer | 4 parts |
| 3,5-Di-tert-butylsalicylic acid chromium complex | 2 parts |

A negatively chargeable insulating magnetic toner having a particle size distribution as shown in Table 1 was prepared from the above ingredients otherwise in the same manner as in Toner Production Example 1, and 100 parts of the magnetic toner and 0.8 part of hydrophobic dry process silica (BET value = 200 $m^2/g$) were blended in a Henschel mixer to obtain a magnetic toner in mixture with silica fine powder was prepared.

The magnetic toner in this mixture state is referred to as Magnetic toner No. 2.

TONER PRODUCTION EXAMPLE 3

| | |
|---|---|
| Styrene/butyl methacrylate/divinyl benzene copolymer (70/29/1; Mw = 35 × $10^4$) | 100 parts |
| Magnetic iron oxide | 70 parts |
| Low-molecular weight ethylene/propylene copolymer | 4 parts |
| Monoazo iron complex | 2 parts |

Magnetic toner No. 3 comprising toner particles having a particle size distribution as shown in Table 1 in mixture with silica fine powder was prepared from the above ingredients otherwise in the same manner as in Toner Production Example 1.

| | |
|---|---|
| Styrene/butyl acrylate/monoethyl maleate/divinylbenzene copolymer (70/25/4/1; Mw = 30 × $10^4$) | 100 parts |
| Magnetic iron oxide | 70 parts |
| Low-molecular weight ethylene/propylene copolymer | 3 parts |
| Tert-butyl-hydroxynaphthoic acid chromium complex | 2 parts |

Magnetic toner No. 4 comprising toner particles having a particle size distribution as shown in Table 1 in mixture with silica fine powder was prepared from the above ingredients otherwise in the same manner as in Toner Production Example 2.

TONER PRODUCTION EXAMPLES 5 AND 6

Magnetic toners Nos. 5 and 6 comprising toner particles having particle size distributions shown in Table 1 respectively in mixture with silica fine powder were prepared from the coarsely crushed product in Toner Production Example 1 under different fin pulverization and classification conditions otherwise in the same manner as in Toner Production Example 1.

The above prepared toner samples were tested for image formation in the following Examples and Comparative Examples under various developing bias conditions described above by using the above-mentioned image forming apparatus. The conditions of the respective Examples are summarized in Table 2 appearing hereinafter. The results of a copying test for 10,000 sheets in the respective Examples are shown in Table 3 (image density and surface state of toner-carrying members) and Table 4 (image evaluation).

EXAMPLES 1-8

Images having high image quality were obtained as shown in Tables 3 and 4. Similarly good results were obtained in a low temperature - low humidity environment of temperature 15° C. and humidity 10% R.H.

In Example 5, a slight coating irregularity was observed on the sleeve corresponding to a non-image part, but no irregularities were observed in toner images even on repetition of development.

REFERENCE EXAMPLE 1

Sleeve No. 1 treated by blasting with indefinite-shaped particles was used.

Somewhat inferior results were obtained in respects of gradation and fog compared with Example 3.

COMPARATIVE EXAMPLE 1

A developing bias with a duty factor of 50% was used. Tailing and toner carrying member memory were observed to provide inferior results in respects of gradation and resolution compared with Example 1.

COMPARATIVE EXAMPLE 2

Generally good images were obtained, but collapsion of characters (poor resolution) due to excessive toner coverage was observed and much toner was consumed.

COMPARATIVE EXAMPLE 3

Good images were obtained at the initial stage but, as the copying was repeated, the image quality was gradually deteriorated with noticeable tailing and unstable reproducibility of thin lines to result in a lower resolution.

TABLE 1

| | Particle size distribution of toner | | | | |
|---|---|---|---|---|---|
| Toner | % by number of particles of ≦5 μm | % by volume of particles of ≧16 μm | % by number of particles of 8-12.7 μm | Volume-average particle size (μm) | (% by number)/(% by volume) of particles of ≦5 μm |
| (Example) | | | | | |
| Toner 1 | 33.8 | 0.0 | 17.9 | 8.03 | 3.7 |
| 2 | 51.6 | 0.0 | 3.5 | 6.17 | 2.1 |
| 3 | 29.3 | 0.2 | 26.2 | 9.06 | 5.4 |
| 4 | 22.0 | 0.0 | 15.5 | 7.52 | 3.3 |
| (Comp. Example) | | | | | |
| Toner 5 | 15.8 | 0.5 | 38.3 | 8.52 | 4.8 |
| 6 | 29.3 | 5.1 | 25.7 | 8.33 | 4.5 |

TABLE 2

| | Developing Conditions | | | | | | |
|---|---|---|---|---|---|---|---|
| | Sleeve | | | Developing bias power supply | | Magnetic toner | |
| | No. | Indefinite-shaped particles | Definite-shaped particles | No. | Duty ratio (%) | No. | Volume-average particle size (μm) |
| Example | | | | | | | |
| 1 | 3 | #400 | #100 | 1 | 20 | 1 | 8 |
| 2 | 4 | #400 | #200 | 2 | 30 | 2 | 6 |
| 3 | 3 | #400 | #100 | 2 | 30 | 3 | 9 |
| 4 | 5 | — | #100 | 1 | 20 | 4 | 7 |
| 5 | 2 | — | #300 | 2 | 30 | 3 | 9 |
| 6 | 4 | #400 | #200 | 3 | 35 | 1 | 8 |

TABLE 2-continued

| | Developing Conditions | | | | | | |
|---|---|---|---|---|---|---|---|
| | Sleeve | | | Developing bias power supply | | Magnetic toner | |
| | No. | Indefinite-shaped particles | Definite-shaped particles | No. | Duty ratio (%) | No. | Volume-average particle size (μm) |
| 7 | 3 | #400 | #100 | 4 | 30 | 4 | 7 |
| 8 | 6 | #400 | #300 | 1 | 20 | 2 | 6 |
| Reference Example 1 | 1 | #400 | — | 2 | 30 | 3 | 9 |
| Comp. Example | | | | | | | |
| 1 | 3 | #400 | #100 | 5 | 50 | 1 | 8 |
| 2 | 3 | #400 | #100 | 1 | 20 | 5 | 8 |
| 3 | 3 | #400 | #100 | 1 | 20 | 6 | 8 |

TABLE 3

| | Initial stage | | After 10,000 sheets | | | |
|---|---|---|---|---|---|---|
| | Dmax | M/S (mg/cm²) | Dmax | M/S (mg/cm²) | Volume-average particle size of toner on sleeve (μm) | Toner coating irregularity* |
| Example | | | | | | |
| 1 | 1.38 | 1.3 | 1.41 | 1.4 | 8.47 | ○ |
| 2 | 1.36 | 1.2 | 1.38 | 1.2 | 6.01 | ○ |
| 3 | 1.34 | 1.4 | 1.37 | 1.3 | 8.97 | ○ |
| 4 | 1.41 | 1.3 | 1.42 | 1.3 | 7.49 | ○ |
| 5 | 1.41 | 1.4 | 1.43 | 1.5 | 9.01 | |
| 6 | 1.37 | 1.3 | 1.40 | 1.3 | 8.63 | ○ |
| 7 | 1.33 | 1.2 | 1.36 | 1.2 | 7.33 | ○ |
| 8 | 1.36 | 1.1 | 1.39 | 1.2 | 6.38 | ○ |
| Reference Example 1 | 1.15 | 1.0 | 1.30 | 1.4 | 9.23 | ○ |
| Comp. Example | | | | | | |
| 1 | 1.36 | 1.3 | 1.35 | 1.4 | .88 | ○ |
| 2 | 1.40 | 1.4 | 1.43 | 1.7 | 9.18 | ○ |
| 3 | 1.35 | 1.3 | 1.28 | 1.6 | 10.54 | ○ |

*Note:
○: Excellent (free from coating irregularity)
: Good, Δ: Acceptable, x: Not acceptable.

TABLE 4

| | Initial stage | | | | After 10,000 sheets | | | |
|---|---|---|---|---|---|---|---|---|
| | Tailing* | Toner carrying member memory** | Thin-line reproducibility (%) | Resolution (lines/mm) | Tailing* | Toner carrying member memory** | Thin-line reproducibility (%) | Resolution (lines/mm) |
| Ex. | | | | | | | | |
| 1 | ○ | ○ | 102 | 7.1 | ○ | ○ | 105 | 7.1 |
| 2 | ○ | ○ | 101 | 9.0 | ○ | ○ | 100 | 9.0 |
| 3 | ○ | ○ | 107 | 6.3 | ○ | ○ | 105 | 6.3 |
| 4 | ○ | | 104 | 8.0 | ○ | ○ | 108 | 7.1 |
| 5 | | | 110 | 5.6 | ○ | | 107 | 6.3 |
| 6 | | ○ | 106 | 7.1 | ○ | | 108 | 6.3 |
| 7 | ○ | | 102 | 6.3 | | ○ | 103 | 7.1 |
| 8 | | ○ | 103 | 9.0 | ○ | ○ | 110 | 8.0 |
| Ref. Ex. 1 | | ○ | 110 | 5.6 | Δ | ○ | 107 | 5.0 |
| Comp. Ex. | | | | | | | | |
| 1 | Δ | Δ | 106 | 6.3 | | Δ | 104 | 5.6 |
| 2 | | ○ | 115 | 5.6 | | ○ | 120 | 5.0 |
| 3 | Δ | ○ | 110 | 6.3 | x | | 80-125 | 4.5 |

*, **: ○: Excellent, : Good, Δ: Acceptable, x: Not acceptable.

As described above, when a magnetic toner having a specific particle size distribution is carried on a toner carrying member having a specific surface unevenness and subjected to development under application of a specific unsymmetrical AC developing bias electric field, the present invention provides excellent effects as follows:

(1) A magnetic toner is uniformly applied onto a toner carrying member to form thereon uniform, thin, short and dense ears of toner particles which are charged uniformly to an appropriate charge level, and the toner particles are effectively flied to provide a high image quality.

(2) It is possible to obtain clear images of high quality which have a high image density and excellent thin-line reproducibility and gradation and are free from fog for a long term.

(3) The toner-carrying member memory is prevented or alleviated.

(4) Clear images of high quality having a high density and free from fog can be obtained even under a low humidity condition.

PRODUCTION EXAMPLES OF A-SI PHOTOSENSITIVE DRUMS

Plural a-Si photosensitive drums were prepared by means of a high-frequency plasma CVD apparatus by using gases of $SiH_4$, $H_2$, $CH_4$, $PH_3$, $B_2H_6$, $GeH_4$, etc., according to the glow discharge process.

(1) An aluminum cylinder substrate of 108 mm diameter and 360 mm length was provided with a lower charge injection-preventing layer of hydrogenated a-Si doped with boron, then with a 25 microns-thick photosensitive layer of hydrogenated a-Si and with a uppermost surface protective layer of hydrogenated a-SiC, whereby Photosensitive drum No. 1 was prepared.

(2) An aluminum cylinder substrate of 108 mm diameter and 360 m length was successively provided with a lower charge injection-preventing layer of hydrogenated a-Si doped with phosphorous, a 25 micron-thick photosensitive layer of hydrogenated a-Si, an upper charge injection-preventing layer of hydrogenated a-Si doped with boron, and a surface protective layer of hydrogenated a-SiC, whereby Photosensitive drum No. 2 was prepared.

The above prepared a-Si photosensitive drums were incorporated in an image forming apparatus as shown in FIG. 1 described below for image formation according to the present invention.

Referring to FIG. 1, an a-Si photosensitive drum as described above was used as the latent image-bearing member 1, the gap $\alpha$ between the latent image-bearing member 1 and the developing sleeve 22 was set at 0.3 mm, and the gap between the developing sleeve 22 and the magnetic doctor blade 24 was set at 0.25 mm to form a magnetic toner layer thickness of about 120 microns on the developing sleeve. The magnetic field given by the magnet roller 23 as measured on the sleeve surface was 1000 gauss at the $N_1$ pole, 1000 gauss at the $S_1$ pole, 750 gauss at the $N_2$ pole and 550 gauss at the $S_2$ pole. A copying test was performed at a rate of 80 sheets (A4)/-min.

Developing bias power supplies used in the test are summarized in Table 5 appearing hereinafter, and the alternating bias voltage waveforms as shown in FIGS. 17–22 were applied by superposing AC and DC voltages.

Magnetic toners prepared in the following manner were used.

TONER PRODUCTION EXAMPLE 7

| | |
|---|---|
| Styrene/butyl methacrylate/divinyl benzene copolymer (70/29.5/0.5; Mw = 35 × $10^4$) | 100 parts |
| Magnetic iron oxide | 80 parts |
| Low-molecular weight ethylene/propylene copolymer | 4 parts |
| Monoazo chromium complex | 2 parts |

The above ingredients were well blended in a blender and melt-kneaded at 150° C. by means of a two-axis extruder. The kneaded product was cooled, coarsely crushed by a cutter mill, finely pulverized by means of a pulverizer using jet air stream, and classified by a fixed-wall type wind-force classifier (DS-type Wind-Force Classifier, mfd. by Nippon Pneumatic Mfg. Co. Ltd.) to obtain a classified powder product. Ultra-fine powder and coarse power were simultaneously and precisely removed from the classified powder by means of a multi-division classifier utilizing a Coanda effect (Elbow Jet Classifier available from Nittetsu Kogyo K.K.), thereby to obtain negatively chargeable insulating black fine powder (magnetic toner). The particle size distribution of the magnetic toner is shown in Table 6 appearing hereinafter.

Then, 100 parts of the thus obtained magnetic toner and 0.6 part of negatively chargeable hydrophobic dry process silica fine powder (BET specific surface area = 300 $m^2/g$) were blended in a Henscel mixer to prepare a magnetic toner in which the silica fine powder was attached to the toner particle surfaces. The magnetic toner in this mixture state is referred to as Magnetic toner No. 7.

TONER PRODUCTION EXAMPLE 8

| | |
|---|---|
| Crosslinked polyester resin (Mw = 6 × $10^4$) | 100 parts |
| Magnetic iron oxide | 90 parts |
| Low-molecular weight ethylene-propylene copolymer | 4 parts |
| 3,5-Di-tert-butylsalicylic acid chromium complex | 2 parts |

Magnetic toner No. 8 comprising toner particles having a particle size distribution as shown in Table 6 in mixture with silica fine powder was prepared from the above ingredients otherwise in the same manner as in Toner Production Example 7.

TONER PRODUCTION EXAMPLE 9

| | |
|---|---|
| Styrene/butyl acrylate/divinylbenzene copolymer (75/24.5/0.5; Mw = 35 × $10^4$) | 100 parts |
| Magnetic iron oxide | 100 parts |
| Low-molecular weight ethylene/propylene copolymer | 3 parts |
| Monoazo chromium complex | 2 parts |

A negative chargeable insulating magnetic toner having a particle size distribution as shown in Table 6 was prepared from the above ingredients otherwise in the same manner as in Toner Production Example 7, and 100 parts of the magnetic toner and 0.8 part of negatively chargeable hydrophobic dry process silica (BET value = 300 $m^2/g$) were blended in a Henschel mixer to obtain a magnetic toner in mixture with silica fine powder was prepared.

The magnetic toner in this mixture state is referred to as Magnetic toner No. 9.

TONER PRODUCTION EXAMPLE 10

| | |
|---|---|
| Styrene/butyl methacrylate/divinyl benzene copolymer (75/24.5/0.5; Mw = 35 × $10^4$) | 80 parts |
| Styrene/butadiene/divinylbenzene copolymer (80/19.5/0.5; Mw = 40 × $10^4$) | 20 parts |
| Magnetic ion oxide | 80 parts |
| Low-molecular weight ethylene/propylene copolymer | 4 parts |
| Nigrosine (charge control agent) | 2 parts |

A negative chargeable insulating magnetic toner having a particle size distribution as shown in Table 6 was prepared from the above ingredients otherwise in the same manner as in Toner Production Example 7, and 100 parts of the magnetic toner and 0.6 part of positively chargeable hydrophobic dry process silica (BET value=200 $m^2/g$) were blended in a Henschel mixer to obtain a magnetic toner in mixture with silica fine powder was prepared.

The magnetic toner in this mixture state is referred to as Magnetic toner No. 10.

TONER PRODUCTION EXAMPLE 11

| | |
|---|---|
| Styrene/butyl acrylate/divinyl benzene copolymer (75/24.5/0.5; Mw = 35 × $10^4$) | 100 parts |
| Magnetic iron oxide | 90 parts |
| Low-molecular weight ethylene/propylene copolymer | 4 parts |
| Nigrosine | 2 parts |

Magnetic toner No. 11 of positive chargeability comprising toner particles having a particle size distribution as shown in Table 6 in mixture with silica fine powder was prepared from the above ingredients otherwise in the same manner as in Toner Production Example 10.

TONER PRODUCTION EXAMPLE 12

| | |
|---|---|
| Styrene/butyl acrylate/divinylbenzene copolymer (75/24.5/0.5; Mw = 35 × $10^4$) | 100 parts |
| Magnetic iron oxide | 80 parts |
| Low-molecular weight ethylene/propylene copolymer | 4 parts |
| Quarternary ammonium salt (charge control agent) | 2 parts |

A positively chargeable insulating magnetic toner having a particle size distribution as shown in Table 6 was prepared from the above ingredients otherwise in the same manner as in Toner Production Example 7, and 100 parts of the magnetic toner and 0.8 part of positively chargeable hydrophobic dry process silica (BET value=200 $m^2/g$) were blended in a Henschel mixer to obtain a magnetic toner in mixture with silica fine powder was prepared.

The magnetic toner in this mixture state is referred to as Magnetic toner No. 12.

TONER PRODUCTION EXAMPLE 13 AND 14 (COMPARATIVE)

Magnetic toner No. 13 comprising toner particles having a particle size distribution shown in Table 6 in mixture with silica fine powder was prepared from the coarsely crushed product in Toner Production Example 7 under different fine pulverization and classification conditions otherwise in the same manner as in Toner Production Example 7.

Similarly, Magnetic toner No. 14 was prepared from the coarsely crushed product in Toner Production Example 10.

The above prepared toner samples were tested for image formation in the following Examples and Comparative Examples under various developing bias conditions described above by using the above-mentioned image forming apparatus. The conditions of the respective Examples are summarized in Table 7 appearing hereinafter. The results of a copying test for 10,000 sheets in the respective Examples are shown in Tables 8 and 9.

EXAMPLES 9-14

Images having a high image density and faithfully reproducing originals could be obtained as shown in Table 8.

The images were excellent in gradation characteristic and almost no toner-carrying member memory was observed.

Incidentally, the difference between the dark part potential and the light part potential was set at +300 V in Examples 9-11 and at −300 V in Examples 12-14.

COMPARATIVE EXAMPLE 4

A similar copying test as in Example 9 was performed except that a developing bias power supply 1 (duty factor=50%) was used instead of the developing bias power supply 6 used in Example 9.

The results are shown in Table 9. Compared with Example 9, inferior results were obtained in respects of image density and resolution and also in respects of fog and halftone reproducibility. As the number of copying sheets was increased, a slight degree of toner carrying member memory was observed.

COMPARATIVE EXAMPLE 5

A similar copying test as in Example 9 was conducted except for using Magnetic toner No. 13.

Good images were obtained at the initial stage but deterioration of image quality was observed at the time of copying 10,000 sheets, when the copying test was interrupted. Table 9 shows the results at the time of copying 10,000 sheets.

COMPARATIVE EXAMPLE 6

A similar copying test as in Example 12 was conducted except for using Magnetic toner No. 14.

The resultant images were good in respects of density and fog, but degradation of fine character images and inferior resolution were observed due to excessive toner coverage.

The above difficulties were pronounced at the time of copying 10,000 sheets, when the copying test was interrupted. Table 9 shows the results at the time of 10,000 sheets.

REFERENCE EXAMPLE 2

A similar copying test as in Example 10 was conducted except that an organic photoconductor (OPC) drum was used instead of Photosensitive drum No. 2 of a-Si. The results are also in Table 9.

Generally good results were obtained at the initial stage, but the resolution and dot-reproducibility were somewhat inferior and the images somewhat lacked sharpness of images.

Fog was observed at the time of copying 50,000 sheets, when the drum surface potential and the DC component of the developing bias voltage were reset so as to provide the same potential contrast as in the initial stage. On further copying, deterioration of image quality was observed compared with Example 10.

The image evaluation was conducted at the time of copying 100,000 sheets after resulting the potential contrast. At this time, the a-Si drum used in Example 10 was loaded to effect further image formation, whereby the same image quality as in Example 10 was obtained.

After copying 100,000 sheets, there were observed not a few scratches and image defects attributable to such scratches began to be observed in the toner images.

TABLE 5

Figure 17:
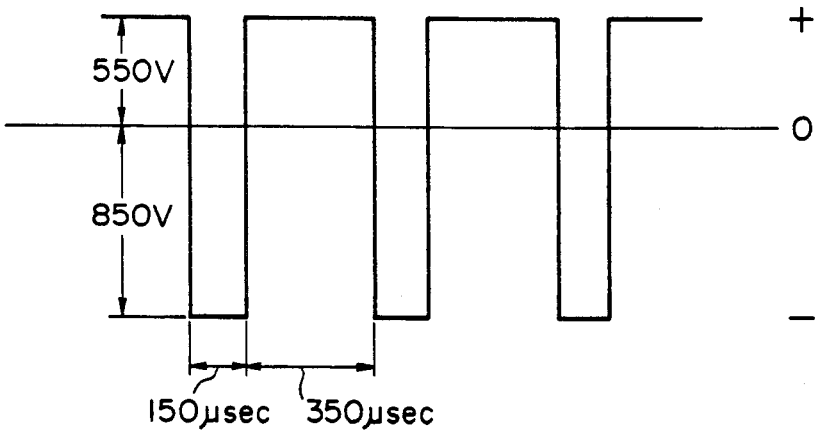
Figure 18:
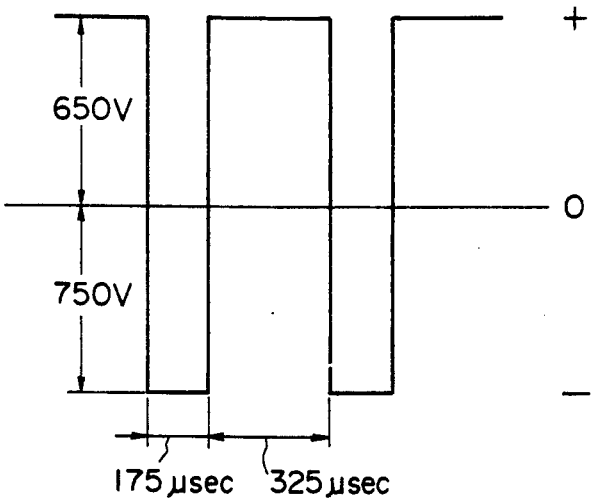
Figure 19:
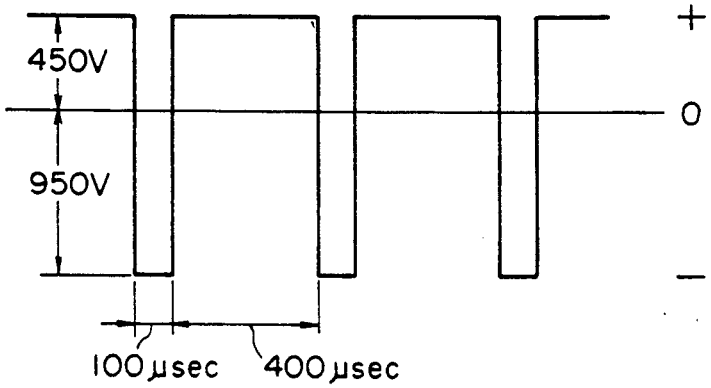
Figure 20:
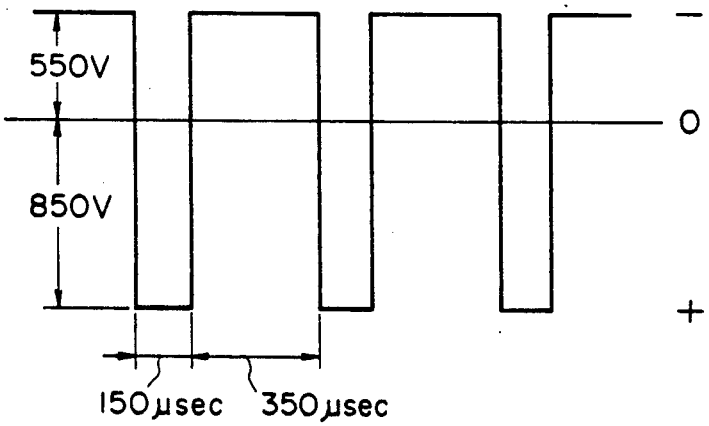
Figure 21:
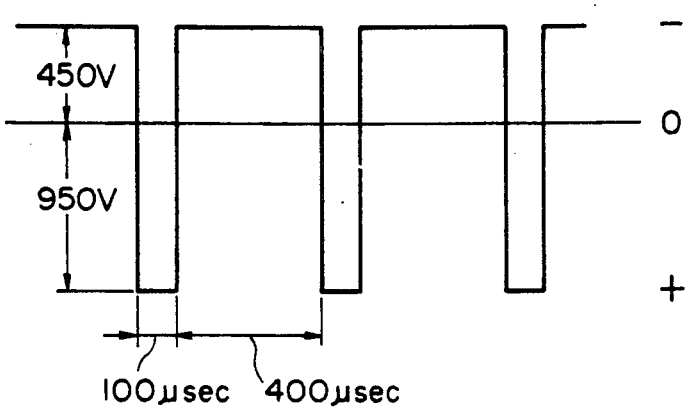
Figure 22:
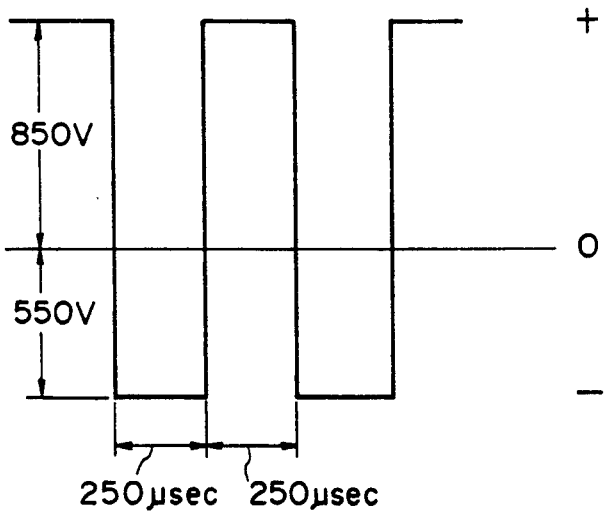

| No. | AC voltage Duty factor (%) | Frequency (Hz) | Peak-to-peak voltage (V) | DC voltage (V) | FIG. No. of waveform diagram |
|---|---|---|---|---|---|
| Supply 6 | 30 | 2000 | 1400 | +150 | FIG. 17 |
| 7 | 35 | 2000 | 1400 | +150 | FIG. 18 |
| 8 | 20 | 2000 | 1400 | +150 | FIG. 19 |
| 9 | 30 | 2000 | 1400 | −150 | FIG. 20 |
| 10 | 20 | 2000 | 1400 | −150 | FIG. 21 |
| (Comp. Ex.) Supply 11 | 50 | 2000 | 1400 | +150 | FIG. 22 |

TABLE 6

| Toner | Particle size distribution of toner: % by number of particles of ≦5 μm | % by volume of particles of ≧16 μm | % by number of particles of 8-12.7 μm | Volume-average particle size (μm) | (% by number)/(% by volume) of particles of ≦5 μm |
|---|---|---|---|---|---|
| (Example) | | | | | |
| Toner 7 | 34.9 | 0.0 | 19.0 | 8.25 | 3.9 |
| 8 | 27.3 | 0.0 | 15.7 | 7.34 | 3.3 |
| 9 | 45.0 | 0.0 | 5.1 | 6.52 | 2.4 |
| 10 | 27.1 | 0.1 | 22.1 | 8.36 | 4.2 |
| 11 | 36.4 | 0.0 | 11.4 | 7.25 | 3.1 |
| 12 | 49.8 | 0.0 | 4.1 | 6.37 | 2.3 |
| (Comp. Example) | | | | | |
| Toner 13 | 37.8 | 4.3 | 23.5 | 8.31 | 4.3 |
| 14 | 7.7 | 0.0 | 39.8 | 8.92 | 7.0 |

TABLE 7

| | Factors of Image Formation: Photosensitive drum No. | Photosensitive drum Material | Developing bias power supply No. | Developing bias power supply Duty ratio | Magnetic toner No. | Magnetic toner Volume-average particle size |
|---|---|---|---|---|---|---|
| Example | | | | | | |
| 9 | 1 | a-Si | 6 | 30 (%) | 7 | 8 (microns) |
| 10 | 1 | a-Si | 7 | 35 | 8 | 7 |
| 11 | 1 | a-Si | 8 | 20 | 9 | 6 |
| 12 | 2 | a-Si | 9 | 30 | 10 | 8 |
| 13 | 2 | a-Si | 9 | 30 | 11 | 7 |
| 14 | 2 | a-Si | 10 | 20 | 12 | 6 |
| Comparative Example | | | | | | |
| 4 | 1 | a-Si | 11 | 50 | 7 | 8 |
| 5 | 1 | a-Si | 6 | 30 | 13 | 8 |
| 6 | 2 | a-Si | 9 | 30 | 14 | 8 |
| Reference Example 2 | — | OPC | 9 | 30 | 10 | 8 |

TABLE 8

| | Initial stage: Dmax 5 mm-dia. dot image | Dmax solid black image | Thin-line reproducibility (%) | Resolution (lines/mm) | After 100,000 sheets: Dmax 5 mm-dia. dot image | Dmax solid black image | Thin-line reproducibility (%) | Resolution (lines/mm) |
|---|---|---|---|---|---|---|---|---|
| Example 7 | 1.40 | 1.41 | 102 | 8.0 | 1.42 | 1.45 | 103 | 8.0 |
| 8 | 1.38 | 1.37 | 101 | 9.0 | 1.39 | 1.39 | 102 | 9.0 |
| 9 | 1.36 | 1.37 | 103 | 9.0 | 1.39 | 1.38 | 100 | 10.0 |
| 10 | 1.40 | 1.42 | 103 | 8.0 | 1.43 | 1.45 | 101 | 8.0 |
| 11 | 1.38 | 1.39 | 104 | 9.0 | 1.41 | 1.40 | 105 | 8.0 |
| 12 | 1.37 | 1.35 | 100 | 10.0 | 1.39 | 1.39 | 101 | 9.0 |

TABLE 9

| | Initial stage: Dmax 5 mm-dia. dot image | Dmax solid black image | Thin-line reproducibility (%) | Resolution (lines/mm) | After 100,000 sheets: Dmax 5 mm-dia. dot image | Dmax solid black image | Thin-line reproducibility (%) | Resolution (lines/mm) |
|---|---|---|---|---|---|---|---|---|
| Comparative Example 4 | 1.32 | 1.30 | 103 | 6.3 | 1.34 | 1.33 | 105 | 6.3 |

TABLE 9-continued

| | Initial stage | | | | After 100,000 sheets | | | |
|---|---|---|---|---|---|---|---|---|
| | Dmax 5 mm-dia. dot image | Dmax solid black image | Thin-line reproducibility (%) | Resolution (lines/mm) | Dmax 5 mm-dia. dot image | Dmax solid black image | Thin-line reproducibility (%) | Resolution (lines/mm) |
| Comparative Example 5 | 1.39 | 1.40 | 102 | 8.0 | 1.32 | 1.30 | 90-120 (On copying 10000 sheets) | 5.0 |
| Comparative Example 6 | 1.41 | 1.37 | 109 | 6.3 | 1.40 | 1.35 | 115 (On copying 10000 sheets) | 5.6 |
| Reference Example 2 | 1.37 | 1.39 | 107 | 6.3 | 1.38 | 1.36 | 90-110 (By OPC drum) | 5.0 |
| | | | | | 1.42 | 1.44 | 102 (By a-Si drum) | 8.0 |

As described above, when a latent image on an a-Si photosensitive member is developed with a magnetic toner having a specific particle size distribution under application of a specific unsymmetrical AC developing bias electric field, the present invention provides excellent effects as follows:

(1) A high density image free from fog and rich in gradation can be obtained even at a small potential contrast.

(2) Delicate latent images are faithfully developed to provide visible images excellent in thin-line reproducibility, dot reproducibility and resolution.

(3) Excellent durability and stability are attained even at a high speed operation to provide a high image quality for a long term.

EXAMPLE 15

A copying test was conducted in the following manner by using an image forming apparatus as shown in FIG. 1 and loaded with a selenium photosensitive drum.

The waveform of the alternating bias voltage (duty factor=20%) used in this example is shown in FIG. 3.

| | |
|---|---|
| Styrene/butyl acrylate/divinyl benzene copolymer (75/24/1; Mw = 30 × $10^4$) | 100 parts |
| Magnetic iron oxide | 80 parts |
| Low-molecular weight ethylene/propylene copolymer | 4 parts |
| Monoazo metal complex (charge control agent) | 1 parts |

The above ingredients were well blended in a blender and melt-kneaded at 150° C. by means of a two-axis extruder. The kneaded product was cooled, coarsely crushed by a cutter mill, finely pulverized by means of a pulverizer using jet air stream, and classified by a fixed-wall type wind-force classifier (DS-type Wind-Force Classifier, mfd. by Nippon Pneumatic Mfg. Co. Ltd.) to obtain a classified powder product. Ultra-fine powder and coarse power were simultaneously and precisely removed from the classified powder by means of a multi-division classifier utilizing a Coanda effect (Elbow Jet Classifier available from Nittetsu Kogyo K.K.), thereby to obtain negatively chargeable insulating black fine powder (magnetic toner). The particle size distribution of the magnetic toner is shown in Table 10 appearing hereinafter.

Then, 100 parts of the thus obtained magnetic toner and 0.6 part of negatively chargeable hydrophobic dry process silica fine powder (BET specific surface area=300 $m^2/g$) were blended in a Henscel mixer to prepare a magnetic toner in which the silica fine powder was attached to the toner particle surfaces. The magnetic toner in this mixture state was used for a copying test of 10,000 sheets. Table 11 appearing hereinafter shows the results of the test, the volume-average particle size of the magnetic toner on the developing sleeve and the amount of charge of the magnetic toner on the developing sleeve measured during the test.

As is clear from Table 11, high-density images excellent in resolution and thin-line reproducibility and free from white ground fog were stably obtained without occurrence of toner carrying member memory. Similarly good results were obtained even in a low temperature - low humidity environment of temperature 10° C. and 10% R.H.

EXAMPLES 16, 17

Copying tests were conducted similarly as in Example 15 except for using magnetic toners as shown in Table 10 which had been obtained by changing the amounts of the magnetic material and the charge control agent, controlling the fine pulverization and classification conditions to obtain particle size distribution as shown and changing the amount of silica fine powder added. The results are shown in Table 11.

Clear images were stably obtained. Similarly good results were obtained in a low temperature - low humidity environment of 15° C. and 10% R.H.

EXAMPLE 18

| | |
|---|---|
| Crosslinked polyester resin (Mw = 6 × $10^4$) | 100 parts |
| Magnetic iron oxide | 80 parts |
| Low-molecular weight ethylene-propylene copolymer | 4 parts |
| 3,5-Di-tert-butylsalicylic acid chromium complex | 1 parts |

A magnetic toner prepared from the above ingredients otherwise in the same manner as in Example 15 showed a particle size distribution (except for the silica) as shown in Table 10.

A copying test was conducted in the same manner as in Example 15 except for using the above magnetic toner and a developing bias power supply which provided an alternating bias voltage waveform as shown in FIG. 4 (duty factor=30%). The results are shown in Table 11.

As is clear from Table 11, images with excellent image qualities were obtained. Similarly good results were obtained in a low temperature - low humidity environment of 15° C. and 10% R.H.

EXAMPLES 19, 20

Copying tests were conducted similarly as in Example 18 except for using magnetic toners as shown in Table 10 which had been obtained by changing the amounts of the magnetic material and the charge control agent, controlling the fine pulverization and classification conditions to obtain particle size distribution as shown and changing the amount of silica fine powder added. The results are shown in Table 11.

Clear images were stably obtained, but a slight degree of toner carrying member memory corresponding to one rotation of the toner-carrying member was observed in Example 19. Similarly good results were obtained in a low temperature - low humidity environment of 15° C. and 10% R.H.

EXAMPLE 21

A copying test was conducted in the same manner as in Example 15 except for using a developing bias power supply which provided an alternating bias voltage waveform as shown in FIG. 5 (duty factor=35%). The results are shown in Table 11.

Similarly good results as in Example 15 were obtained also in this case.

COMPARATIVE EXAMPLE 7

A copying test was conducted in the same manner as in Example 15 except for using a developing bias power supply which provided an alternating bias voltage waveform as shown in FIG. 9 (duty factor=50%). The results are shown in Table 11.

Compared with the images in Example 15, the resultant images were inferior in gradation characteristic, somewhat inferior in resolution and thin-line reproducibility and accompanied with a some degree of white ground fog. Also toner carrying member memory was observed.

COMPARATIVE EXAMPLE 8

A copying test was conducted in the same manner as in Example 15 except for using a magnetic toner as shown in Table 10 which had been obtained from the coarsely crushed product in Example 15 by changing the fine pulverization and classification conditions to obtain a particle size distribution shown in Table 10. The results are shown in Table 11.

Good images were obtained at the initial stage but, on further continuation of the copying, gradually rough images were obtained with inferior resolution and thin-line reproducibility.

COMPARATIVE EXAMPLE 9

| | |
|---|---|
| Styrene/butyl acrylate/divinyl benzene copolymer (75/24/1; Mw = 30 × $10^4$) | 100 parts |
| Magnetic iron oxide | 80 parts |
| Low-molecular weight ethylene/propylene copolymer | 4 parts |
| 3,5-Di-tert-butylsalicylic acid zinc complex | 0.5 parts |

A magnetic toner prepared from the above ingredients otherwise in the same manner as in Example 15 showed a particle size distribution shown Table 10 and provided results shown in Table 11 as a result of copying test which was conducted in the same manner as in Example 15.

The resultant images showed a low image density because of hollow images (middle dropout) and showed unstable line thicknesses.

COMPARATIVE EXAMPLE 10

| | |
|---|---|
| Crosslinked polyester resin (Mw = 6 × $10^4$) | 100 parts |
| Magnetic iron oxide | 80 parts |
| Low-molecular weight ethylene/propylene copolymer | 4 parts |
| 3,5-Di-tert-butylsalicylic acid chromium complex | 3 parts |

A magnetic toner prepared from the above ingredients otherwise in the same manner as in Example 15 showed a particle size distribution shown Table 10 and provided results shown in Table 11 as a result of a copying test which was conducted in the same manner as in Example 15.

Good images were obtained at the initial stage but, on continuation of the copying, the image density was lowered and toner carrying member memory was observed. These tendency became pronounced in a similar copying test in a low temperature - low humidity environment of 15° C. and 10% R.H.

Figure 15:
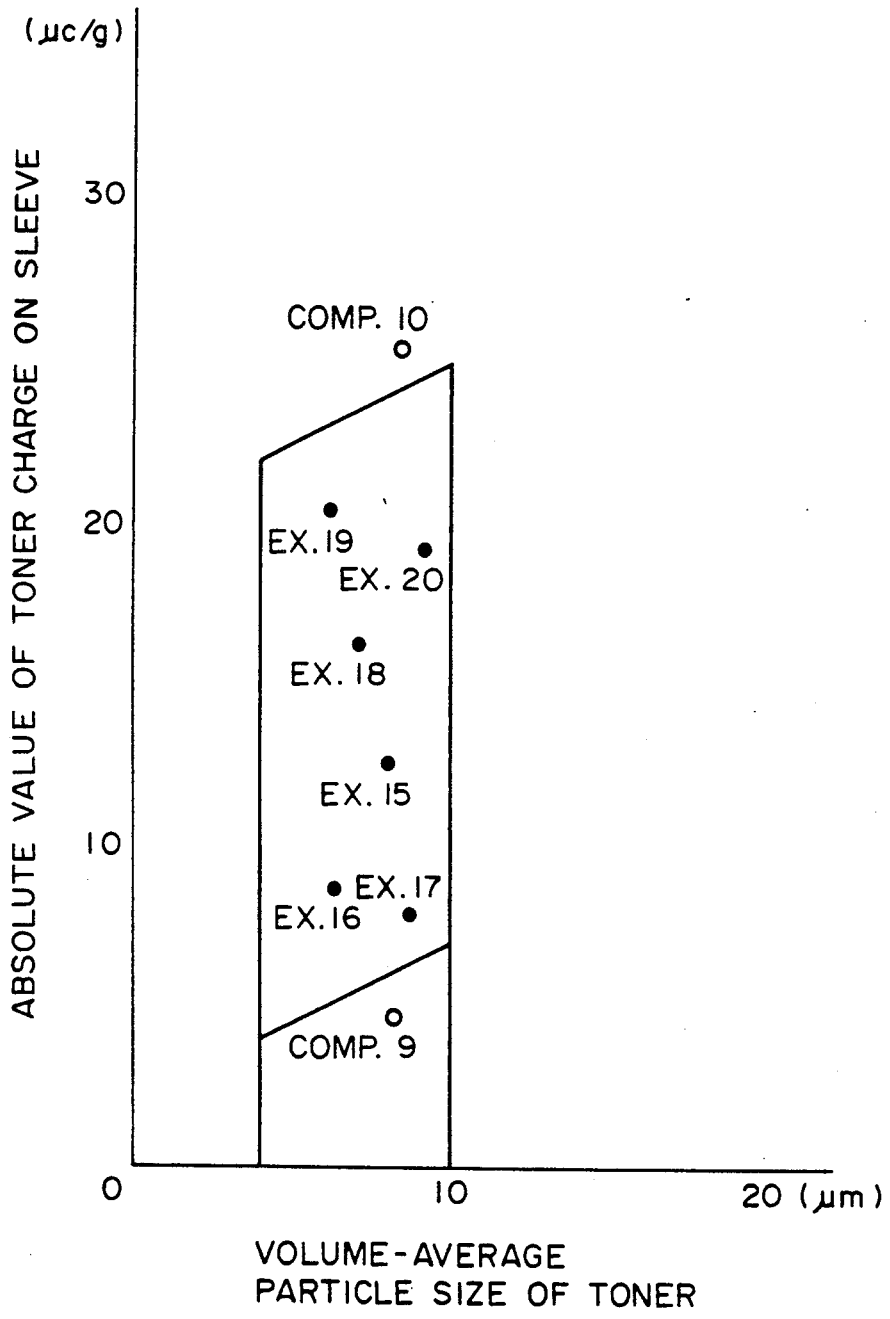
FIG. 15 is a graph showing a distribution of volume-average particle sizes and toner charges (uC/g) on toner-carrying members obtained according to Examples and Comparative Examples.
Figure 16:
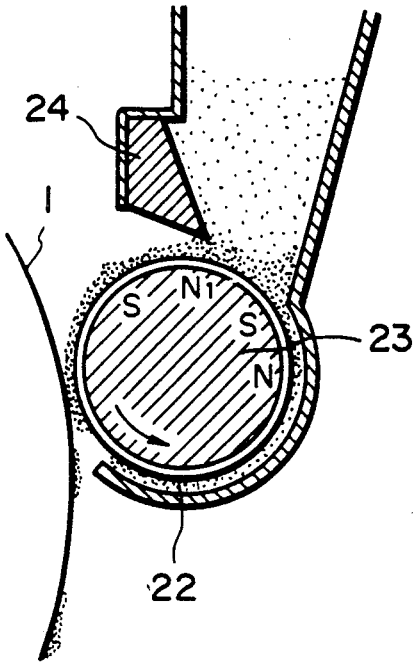
FIG. 16 is an illustration of a toner layer regulation member.

FIG. 15 shows a relationship between the volume-average particle size and the charge on the toner-carrying member (developing sleeve) of the magnetic toners tested in Examples and Comparative Examples.

TABLE 10

| | Charge control agent (wt. parts) | Magnetic material (wt. parts) | Silica (wt. parts) | Particle size distribution of toner: % by number of particles of ≦5 μm | % by volume of particles of ≧16 μm | % by number of particles of 8-12.7 μm | Volume-average particle size (μm) |
|---|---|---|---|---|---|---|---|
| Ex. | | | | | | | |
| 15 | 1.0 | 80 | 0.6 | 28.6 | 0.0 | 21.7 | 8.05 |
| 16 | 2.0 | 110 | 1.0 | 47.6 | 0.0 | 4.5 | 6.45 |
| 17 | 1.0 | 80 | 0.6 | 23.0 | 0.1 | 29.4 | 8.67 |
| 18 | 1.0 | 80 | 0.6 | 34.5 | 0.0 | 11.2 | 7.16 |
| 19 | 2.0 | 90 | 0.8 | 51.6 | 0.0 | 2.9 | 6.15 |
| 20 | 2.0 | 70 | 0.6 | 22.1 | 0.2 | 27.5 | 9.21 |
| Comp. Ex. | | | | | | | |
| 7 | 1.0 | 80 | 0.6 | 28.6 | 0.0 | 21.7 | 8.05 |
| 8 | 1.0 | 80 | 0.6 | 23.8 | 5.0 | 22.6 | 8.37 |
| 9 | 0.5 | 90 | 0.6 | 33.8 | 2.5 | 17.9 | 8.16 |
| 10 | 3.0 | 70 | 0.6 | 40.5 | 0.0 | 36.0 | 8.26 |

TABLE 11

| | Initial stage | | | | After 10,000 sheets | | | | | |
|---|---|---|---|---|---|---|---|---|---|---|
| | Dmax 5 mm-dia. dot image | Dmax solid black image | Thin-line reproducibility (%) | Resolution (lines/mm) | Dmax 5 mm-dia. dot image | Dmax solid black image | Thin-line reproducibility (%) | Resolution (lines/mm) | $\overline{Dv}$* (μm) | Charge of tones on sleeve (μc/g) |
| Ex. | | | | | | | | | | |
| 15 | 1.38 | 1.37 | 105 | 6.3 | 1.42 | 1.39 | 103 | 6.3 | 8.31 | −12.5 |
| 16 | 1.36 | 1.34 | 103 | 7.1 | 1.35 | 1.33 | 104 | 7.1 | 6.37 | −8.6 |
| 17 | 1.31 | 1.30 | 107 | 6.3 | 1.32 | 1.31 | 98 | 5.6 | 9.15 | −7.9 |
| 18 | 1.40 | 1.39 | 103 | 7.1 | 1.45 | 1.44 | 103 | 6.3 | 7.03 | −16.1 |
| 19 | 1.37 | 1.35 | 107 | 7.1 | 1.38 | 1.36 | 106 | 6.3 | 8.30 | −20.3 |
| 20 | 1.34 | 1.34 | 104 | 6.3 | 1.33 | 1.34 | 109 | 6.3 | 9.45 | −19.0 |
| 21 | 1.39 | 1.39 | 106 | 6.3 | 1.43 | 1.40 | 104 | 6.3 | 8.44 | −11.9 |
| Comp. Ex. | | | | | | | | | | |
| 7 | 1.37 | 1.35 | 110 | 5.6 | — | — | — | — | — | — |
| 8 | 1.35 | 1.34 | 103 | 6.3 | 1.30 | 1.21 | 90-120 | 5.0 | 11.71 | −13.7 |
| 9 | 1.12 | 1.05 | 85-130 | 6.3 | 1.09 | 1.99 | 80-120 | 5.6 | 9.02 | −4.6 |
| 10 | 1.40 | 1.38 | 102 | 6.3 | 1.22 | 1.18 | 90 | 5.6 | 7.51 | −25.3 |

$\overline{Dv}$*: Volume-average particle size

As described above, when a magnetic toner having a specific particle size distribution and a specific triboelectric charge is used for development under application of a specific unsymmetrical AC developing bias electric field, the present invention provides excellent effects as follows:

(1) It is possible to successively provide toner images having a high image density and free from fog.

(2) It is possible to provide high-quality toner images rich in gradation and excellent in resolution and thin-line reproducibility.

(3) Decrease in image density is not caused even under a low humidity condition.

What is claimed is:

1. An image forming method, comprising:

disposing a latent image-bearing member for holding an electrostatic image thereon and a toner-carrying member for carrying a magnetic toner with a prescribed gap at a developing station, the magnetic toner comprising a binder resin and magnetic powder and having a particle size distribution including 12% by number or more of magnetic toner particles of 5 microns or smaller, 33% by number or less of magnetic toner particles of 8-12.7 microns and 2% by volume or less of magnetic toner particles of 16 microns or larger so as to provide a volume-average particle size of 4-10 microns;

conveying the magnetic toner in a layer carried on the toner-carrying member and regulated in a thickness thinner than the prescribed gap to the developing station; and applying an alternating bias voltage comprising a DC bias voltage and an asymmetrical AC bias voltage in superposition between the toner-carrying member and the latent image-bearing member at the developing station to provide an alternating bias electric field comprising a development-side voltage component and a reverse development-side voltage component, the development-side voltage component having a magnitude equal to or larger than that of the reverse development-side voltage component and a duration smaller than that of the reverse-development side voltage component, so that the magnetic toner on the toner-carrying member is transferred to the latent image-bearing member to develop the electrostatic image thereon at the developing station.

2. The image forming method according to claim 1, wherein the alternating bias voltage has a frequency of 1.0-5.0 KHz.

3. The image forming method according to claim 1, wherein the alternating bias voltage has a duty factor of 10-40%.

4. The image forming method according to claim 1, wherein the alternating bias voltage has a peak-to-peak value of 1.0-2.0 KV.

5. The image forming method according to claim 1, wherein the magnetic toner contains 12-60% by number of magnetic toner particles of 5 microns or smaller.

6. The image forming method according to claim 1, wherein the magnetic toner has a volume-average particle size of 6-10 microns, contains 12-60% by number of magnetic toner particles of 5 microns or smaller, and satisfies the condition of $N/V = -0.04N + k$, wherein N is a number of 12-60 denoting the content in terms of % by number of the toner particles of 5 microns or smaller, V is a number denoting the content in terms of % by volume of the toner particles of 5 microns or smaller, and k is a number of 4.5-6.5.

7. The image forming method according to claim 1, wherein the alternating bias voltage has a frequency of 1.0-5.0 KHz, a peak-to-peak voltage of 1.0-2.0 KV and a duty factor of 10-40%, and the magnetic toner contains 12-60% by the number of toner particles of 5 microns or smaller.

8. The image forming method according to claim 7, wherein the magnetic toner has a volume-average particle size of 6-10 microns, contains 12-60% by number of magnetic toner particles of 5 microns or smaller, and satisfies the condition of $N/V = -0.04N + k$, wherein N is a number of 12-60 denoting the content in terms of % by number of the toner particles of 5 microns or smaller, V is a number denoting the content in terms of % by volume of the toner particles of 5 microns or smaller, and k is a number of 4.5-6.5.

9. The image forming method according to claim 1, wherein the latent image-bearing member comprises a photosensitive layer of a-Si.

10. The image forming method according to claim 1, wherein the latent image-bearing member comprises a photosensitive layer of a-Si and a surface protective layer of hydrogenated a-SiC.

11. The image forming method according to claim 1, wherein the latent image-bearing member comprises a photosensitive layer of a-Si and provides a difference between a dark-part potential and a light-part potential of 250–400 V.

12. The image forming method according to claim 11, wherein the latent image-bearing member provides a difference between a dark-part potential and a light-part potential of 250–350 V.

13. The image forming method according to claim 1, wherein the toner-carrying member has an uneven surface formed by blasting with regularly-shaped particles.

14. The image forming method according to claim 13, wherein the toner-carrying member has a surface roughness of 0.1–5 microns.

15. The image forming method according to claim 13, wherein the toner-carrying member has an unevenness originated from the regularly-shaped particles having a diameter or a long-axis diameter of 10–250 microns.

16. The image forming method according to claim 1, wherein the toner-carrying member has an uneven surface formed by blasting with irregularly-shaped particles and then with regularly-shaped particles.

17. The image forming method according to claim 16, wherein the toner-carrying member has a surface roughness of 0.1–5 microns.

18. The image forming method according to claim 16, wherein the toner-carrying member has an unevenness originated from the regularly-shaped particles having a diameter or long-axis diameter of 10–250 microns.

19. The image forming method according to claim 1, wherein the toner-carrying member has an uneven surface formed by blasting with a mixture of regularly-shaped particles and irregularly-shaped particles.

20. The image forming method according to claim 19, wherein the toner-carrying member has a surface roughness of 0.1–5 microns.

21. The image forming method according to claim 19, wherein the toner-carrying member has an unevenness originated from the regularly-shaped particles having a diameter or a long-axis diameter of 20–250 microns.

22. The image forming method according to claim 1, wherein the magnetic toner satisfies a condition of the formula:

$$2(\mu c/g)+0.5(\mu c/g)R \leqq Q(\mu c/g) \leqq 20(\mu c/g)+0.5(\mu c/g)R \quad (1)$$

wherein R is a number satisfying the relation of $4 \leqq R \leqq 10$ and representing the volume-average particle size ($\mu$m) of the magnetic toner, and Q represents the absolute value of the triboelectric charge of the magnetic toner on the toner-carrying member.

23. The image forming method according to claim 22, wherein the magnetic toner satisfies a condition of the formula:

$$4(\mu c/g)+0.5(\mu c/g)R \leqq Q(\mu c/g) \leqq 18(\mu c/g)+0.5(\mu c/g)R \quad (2),$$

wherein R and Q are the same as in the formula (1).

* * * * *

UNITED STATES PATENT AND TRADEMARK OFFICE

CERTIFICATE OF CORRECTION

PATENT NO. : 5,175,070

DATED : December 29, 1992

INVENTOR(S) : TANIKAWA ET AL.

It is certified that error appears in the above-identified patent and that said Letters Patent is hereby corrected as shown below:

COLUMN 4

Line 10, "carrying carrying" should read "carrying member. Accordingly, a light degree of toner-carrying--.

COLUMN 9

Line 52, "duration" should read --duration of--.
Line 66, "Almost a" should read --Almost the entire--.

COLUMN 10

Line 44, "cause" should be deleted.

COLUMN 11

Line 6, "flied" should read --flown--.

COLUMN 12

Line 6, "below" should read --below, in--.
Line 29, "alleviated. As" should read --alleviated, as--.
Line 42, "surface fly" should read --surface to fly--.

COLUMN 13

Line 24, "be" should be deleted.
Line 34, "saw-teeth" should read --saw-tooth--.

UNITED STATES PATENT AND TRADEMARK OFFICE

CERTIFICATE OF CORRECTION

PATENT NO. : 5,175,070

DATED : December 29, 1992

INVENTOR(S) : TANIKAWA ET AL.

It is certified that error appears in the above-identified patent and that said Letters Patent is hereby corrected as shown below:

COLUMN 14

Line 35, "less" should read --reduced--.
Line 36, "result" should read --resulting--.
Line 42, "in case" should read --in a case--.
Line 63, "is" should read --are--.
Line 68, "satisfy" should read --satisifies--.

COLUMN 15

Line 1, "is" should read --are--.

COLUMN 16

Line 28, "flied" should read --flown--.
Line 33, "shape toner" should read --shape of the toner--.
Line 63, "reproducibilities in" should read --reproduction of--.
Line 67, "well" should read --successfully--.
Line 68, "a" (first occurrence) should be deleted.

COLUMN 17

Line 2, "in respect of" should read --with respect to--.
Line 3, "ical factor" should read --ic factors--.
Line 59, "flied to be" should read --flown, and--.
Line 63, "flied" should read --flown--.
Line 64, "the" (second occurrence) should be deleted.

UNITED STATES PATENT AND TRADEMARK OFFICE

CERTIFICATE OF CORRECTION

PATENT NO. : 5,175,070

DATED : December 29, 1992

INVENTOR(S) : TANIKAWA ET AL.

It is certified that error appears in the above-identified patent and that said Letters Patent is hereby corrected as shown below:

COLUMN 18

Line 2, "respects of" should read --respect to--.
Line 16, "i" should read --is--.
Line 26, "p-nhexylstyrene" should read --p-n-hexylstyrene--.
Line 61, "peti-" should read --petr--.

COLUMN 20

Line 33, "one" should read --ones--.

COLUMN 21

Line 36, "atom;" should read --atoms;--.
Line 43, "along" should read --alone--.

COLUMN 22

Line 22, "as" should read --an--.
Line 29, "in latent" should read --in a latent--.
Line 33, "in latent" should read --in a latent--.
Line 39, "frequency contact" should read --frequency of contact--.
Line 50, "flied" should read --flown--.
Line 65, "flied" should read --flown--.

COLUMN 23

Line 6, "to" should be deleted.
Line 49, "flied" should read --flown--.

UNITED STATES PATENT AND TRADEMARK OFFICE

CERTIFICATE OF CORRECTION

PATENT NO. : 5,175,070

DATED : December 29, 1992

INVENTOR(S) : TANIKAWA ET AL.

It is certified that error appears in the above-identified patent and that said Letters Patent is hereby corrected as shown below:

COLUMN 25

Line 9, "the" should be deleted.
Line 10, "size of" should be deleted, and "the, latter." should read --the size of the latter.--
Line 56, "flied" should read --flown--.
Line 57, "flied" should read --flown--.

COLUMN 26

Line 5, "ununiformly" should read --non-uniformly--.
Line 12, "result" should read --results--.

COLUMN 31

Line 14, After "Example 1." start new paragraph --Toner Production Example 4--.
Line 36, "fin" should read --fine--.

COLUMN 32

Line 32, "collapsion" should read --degradation--.

UNITED STATES PATENT AND TRADEMARK OFFICE

CERTIFICATE OF CORRECTION

PATENT NO. : 5,175,070

DATED : December 29, 1992

INVENTOR(S) : TANIKAWA ET AL.

It is certified that error appears in the above-indentified patent and that said Letters Patent is hereby corrected as shown below:

COLUMN 33

"TABLE 3" should read as follows:

Table 3

| | Initial stage | | After 10,000 sheets | | | |
|---|---|---|---|---|---|---|
| | Dmax | M/S ($mg/cm^2$) | Dmax | M/S ($mg/cm^2$) | Volume-average particle size of toner on sleeve (μm) | Toner coating irregularity * |
| Example 1 | 1.38 | 1.3 | 1.41 | 1.4 | 8.47 | ◎ |
| 2 | 1.36 | 1.2 | 1.38 | 1.2 | 6.01 | ◎ |
| 3 | 1.34 | 1.4 | 1.37 | 1.3 | 8.97 | ◎ |
| 4 | 1.41 | 1.3 | 1.42 | 1.3 | 7.49 | ◎ |
| 5 | 1.41 | 1.4 | 1.43 | 1.5 | 9.01 | ○ |
| 6 | 1.37 | 1.3 | 1.40 | 1.3 | 8.63 | ◎ |
| 7 | 1.33 | 1.2 | 1.36 | 1.2 | 7.33 | ◎ |
| 8 | 1.36 | 1.1 | 1.39 | 1.2 | 6.38 | ◎ |
| Reference Example 1 | 1.15 | 1.0 | 1.30 | 1.4 | 9.23 | ◎ |
| Comp. Example 1 | 1.36 | 1.3 | 1.35 | 1.4 | 7.88 | ◎ |
| 2 | 1.40 | 1.4 | 1.43 | 1.7 | 9.18 | ◎ |
| 3 | 1.35 | 1.3 | 1.28 | 1.6 | 10.54 | ◎ |

*Note: ◎: Excellent (free from coating irregularity)
○: Good, Δ: Acceptable, x: Not acceptable.

UNITED STATES PATENT AND TRADEMARK OFFICE

CERTIFICATE OF CORRECTION

PATENT NO. : 5,175,070

DATED : December 29, 1992

INVENTOR(S) : TANIKAWA ET AL.

It is certified that error appears in the above-indentified patent and that said Letters Patent is hereby corrected as shown below:

"TABLE 4" should read as follows:

Table 4

| | Initial stage | | | | After 10,000 sheets | | | |
|---|---|---|---|---|---|---|---|---|
| | Tailing* | Toner carrying member memory** | Thin-line reproducibility (%) | Resolution (lines/mm) | Tailing* | Toner carrying member memory** | Thin-line reproducibility (%) | Resolution (lines/mm) |
| Ex. 1 | ◎ | ◎ | 102 | 7.1 | ◎ | ● | 105 | 7.1 |
| 2 | ◎ | ◎ | 101 | 9.0 | ◎ | ● | 100 | 9.0 |
| 3 | ◎ | ◎ | 107 | 6.3 | ◎ | ◎ | 105 | 6.3 |
| 4 | ◎ | ○ | 104 | 8.0 | ◎ | ◎ | 108 | 7.1 |
| 5 | ○ | ○ | 110 | 5.6 | ◎ | ○ | 107 | 6.3 |
| 6 | ○ | ◎ | 106 | 7.1 | ◎ | ○ | 108 | 6.3 |
| 7 | ◎ | ○ | 102 | 6.3 | ○ | ◎ | 103 | 7.1 |
| 8 | ○ | ◎ | 103 | 9.0 | ◎ | ◎ | 110 | 8.0 |
| Ref. Ex. 1 | ○ | ◎ | 110 | 5.6 | Δ | ◎ | 107 | 5.0 |
| Comp. Ex. 1 | Δ | Δ | 106 | 6.3 | ○ | Δ | 104 | 5.6 |
| 2 | ○ | ◎ | 115 | 5.6 | ○ | ◎ | 120 | 5.0 |
| 3 | Δ | ◎ | 110 | 6.3 | x | ○ | 80-125 | 4.5 |

*, **: ● Excellent, ○: Good, Δ: Acceptable, x: Not acceptable.

UNITED STATES PATENT AND TRADEMARK OFFICE

CERTIFICATE OF CORRECTION

PATENT NO. : 5,175,070

DATED : December 29, 1992

INVENTOR(S) : TANIKAWA ET AL.

It is certified that error appears in the above-identified patent and that said Letters Patent is hereby corrected as shown below:

Line 63, "unsymmetrical" should read --asymmetrical--.

COLUMN 34

Line 61, "flied" should read --flown--

COLUMN 36

Line 49, "was prepared" should be deleted.

COLUMN 37

Line 4, "was prepared" should be deleted.
Line 42, "was prepared" should be deleted.

COLUMN 38

Line 55, "of images" should be deleted.

COLUMN 41

Line 18, "unsymmetrical" should read --asymmetrical--.

COLUMN 44

Line 43, "tendency" should read --tendencies--.

UNITED STATES PATENT AND TRADEMARK OFFICE

CERTIFICATE OF CORRECTION

PATENT NO. : 5,175,070

DATED : December 29, 1992

INVENTOR(S) : TANIKAWA ET AL.

It is certified that error appears in the above-identified patent and that said Letters Patent is hereby corrected as shown below:

COLUMN 45

Line 25, "unsymmetrical" should read --asymmetrical--.

COLUMN 47

Line 17, "10-250 microns" should read --20-250 microns--.
Line 28, "10-250 microns" should read --20-250 microns--.

COLUMN 48

Line 15, "(1)" should read --(1),--.

Signed and Sealed this

Twenty-second Day of February, 1994

*Attest:*

Bruce Lehman

BRUCE LEHMAN

*Attesting Officer*

*Commissioner of Patents and Trademarks*